US009702048B2

(12) United States Patent
Imai

(10) Patent No.: US 9,702,048 B2
(45) Date of Patent: Jul. 11, 2017

(54) LIQUID TREATMENT APPARATUS

(71) Applicant: Panasonic Intellectual Property Management Co., Ltd., Osaka (JP)

(72) Inventor: Shin-Ichi Imai, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 10 days.

(21) Appl. No.: 14/797,537

(22) Filed: Jul. 13, 2015

(65) Prior Publication Data

US 2016/0032466 A1 Feb. 4, 2016

(30) Foreign Application Priority Data

Jul. 30, 2014 (JP) ..... 2014-155278

(51) Int. Cl.

| | |
|---|---|
| ***C25B 9/08*** | (2006.01) |
| ***C25B 1/22*** | (2006.01) |
| ***C25B 9/04*** | (2006.01) |
| ***H05H 1/48*** | (2006.01) |

(52) U.S. Cl.

CPC ..... *C25B 9/08* (2013.01); *C25B 1/22* (2013.01); *C25B 9/04* (2013.01); *H05H 1/48* (2013.01); *H05H 2001/481* (2013.01)

(58) Field of Classification Search

CPC ..... C02F 2201/46135; C02F 2209/40; C02F 1/4695; C02F 2201/46145; C02F 2303/04; C02F 2201/4611; C02F 1/001; C02F 2001/425; C02F 2301/046; C02F 2307/14

USPC ..... 204/242, 554, 556, 660, 661

See application file for complete search history.

(56) References Cited

U.S. PATENT DOCUMENTS

| | | | | |
|---|---|---|---|---|
| 5,766,447 | A | 6/1998 | Creijghton | |
| 2004/0007539 | A1* | 1/2004 | Denes | C02F 1/4608 210/748.18 |
| 2014/0014516 | A1* | 1/2014 | Kumagai | C02F 1/4608 204/556 |

FOREIGN PATENT DOCUMENTS

| | | |
|---|---|---|
| JP | 11-077050 | 3/1999 |
| JP | 2007-007557 | 1/2007 |
| JP | 2009-106910 | 5/2009 |
| JP | 2010-188228 | 9/2010 |

(Continued)

OTHER PUBLICATIONS

Goodbridge et al.; "Experimental Methods and Equipment"; 1974; pp. 68-71.*

*Primary Examiner* — Zulmariam Mendez

(74) *Attorney, Agent, or Firm* — McDermott Will & Emery LLP

(57) ABSTRACT

A liquid treatment apparatus according to an aspect of the present disclosure comprises a reactor and a plasma generator. The reactor includes an inner wall, a first space, and a second space. Each of the first space and a second space is capable of containing a liquid. The liquid is suppressed to move between the first space and the second space. The inner wall allows ions or electrons to move between the first space and the second space. The plasma generator includes a first electrode at least partially located in the first space, a second electrode at least partially located in the second space, and a power supply that applies AC or pulse voltage between the first electrode and the second electrode. The plasma generator produces plasma in the liquid.

17 Claims, 14 Drawing Sheets

(56) References Cited

FOREIGN PATENT DOCUMENTS

| | | |
|---|---|---|
| JP | 2012-052209 | 3/2012 |
| JP | 2012-075973 | 4/2012 |

* cited by examiner

LIQUID TREATMENT APPARATUS

BACKGROUND

1. Technical Field

The present disclosure relates to a liquid treatment apparatus using plasma.

2. Description of the Related Art

Water ionizers, i.e., apparatuses that produce ionized water using the electrolysis of water, are known. For example, the water ionizer described in Japanese Unexamined Patent Application Publication No. 2012-75973 performs electrolysis by forming a discharge-field-mediated current path between a pair of electrodes immersed in distilled water. The apparatus applies voltage to the pair of electrodes to initiate a streamer discharge in the discharge field. The publication states that the electrolysis of water produces acidic water on the positive electrode side and alkaline water on the negative electrode side.

SUMMARY

One non-limiting and exemplary embodiment provides a liquid treatment apparatus that produces alkaline and acidic waters with sufficiently high concentrations.

In one general aspect, the techniques disclosed here feature a liquid treatment apparatus. The liquid treatment apparatus comprises a reactor and a plasma generator. The reactor includes an inner wall, a first space, and a second space. Each of the first space and the second space is capable of containing a liquid. The liquid is suppressed to move between the first space and the second space. The inner wall allows ions or electrons to move between the first space and the second space. The plasma generator includes a first electrode at least partially located in the first space, a second electrode at least partially located in the second space, and a power supply that applies AC or pulse voltage between the first electrode and the second electrode. The plasma generator produces plasma in the liquid.

It should be noted that general or specific embodiments may be implemented as an apparatus, a device, a system, an integrated circuit, a method, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
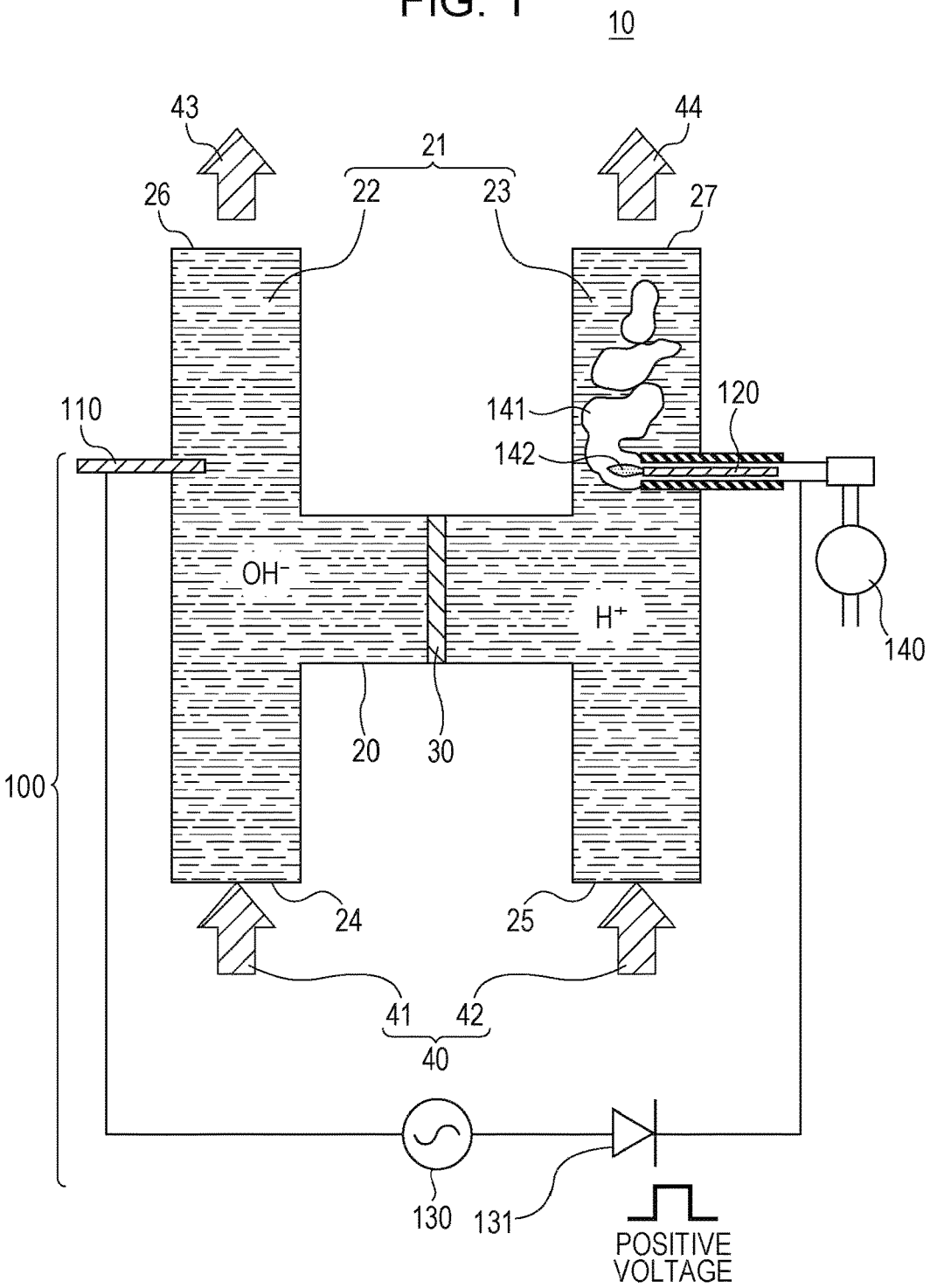
FIG. 1 illustrates the structure of a liquid treatment apparatus according to Embodiment 1.

Underlying Knowledge Forming Basis of the Present Disclosure

The inventor has found the following problems with the water ionizers mentioned in "Description of the Related Art."

Performing electrolysis of water by generating a discharge field in the water should require controlling the flow of the water. For example, a large flow of water makes the bulk resistivity of the water instable, disturbing the discharge field and other conditions and resulting in incomplete formation of the current path. This may affect the electrolytic performance. A large flow of water can also cause the produced alkaline and acidic waters to be mixed and neutralized.

The water ionizer described in the aforementioned publication, Japanese Unexamined Patent Application Publication No. 2012-75973, has an electrolytic cell having two compartments partitioned by a partition having a throughhole. In each compartment, supplying and draining of water produce a large flow of water. This apparatus is therefore a flowing water system. The inventor applied voltage to the pair of electrodes in this type of apparatus but the concentration of the obtained alkaline water was not sufficiently high, seemingly because of inadequate control of the flow of water in the electrolytic cell.

This result suggested that acidic and alkaline waters with sufficiently high concentrations can be obtained only when the flow of water is controlled. The inventor also tried to find a method in which the flow of water need not be controlled.

A liquid treatment apparatus according to an aspect of the present disclosure comprises a reactor and a plasma generator. The reactor includes an inner wall, a first space, and a second space. Each of the first space and the second space is capable of containing a liquid. The liquid is suppressed to move between the first space and the second space. The inner wall allows ions or electrons to move between the first space and the second space. The plasma generator includes a first electrode at least partially located in the first space, a second electrode at least partially located in the second space, and a power supply that applies AC or pulse voltage between the first electrode and the second electrode. The plasma generator produces plasma in the liquid.

The ions or electrons permeability of the inner wall of the reactor ensures a current path between the first and second electrodes, allowing alkaline and acidic waters to be produced through the electrolysis of water. Furthermore, a discharge and plasma can be occurred near the first electrode or the second electrode. The limited movement of the liquid between the first and second spaces prevents the mixing of the alkaline water produced in the first space and the acidic water produced in the second space. In this way, limited movement of the liquid between the first and second spaces allows simultaneous production of alkaline and acidic waters.

In the above structure, the inner wall may include a partition that separates the first space and the second space. The partition may allow ions or electrons to move between the first space and the second space.

In the above structure, the partition may include an ion-exchange membrane or an electron conductive membrane.

In the above structure, the partition may include a porous membrane.

The membranes ensure stable discharge and plasma generation by limiting the movement of the liquid between the first and second spaces.

In the above structure, the separating layer that serves as the partition may be a volume of water that exists between the first and second spaces and in which the water pressure is kept higher than in the first and second spaces.

This allows the production of a kind of water that is alkaline first and turns acidic after a predetermined period of time as a result of a change in water pressure.

In the above structure, the reactor may have: a first inlet through which the liquid is supplied into the first space; a second inlet through which the liquid is supplied into the second space; a first outlet through which the liquid is drained from the first space; and a second outlet through which the liquid is drained from the second space.

The first inlet and the first outlet form a flow of the liquid in the first space, and the second inlet and the second outlet form a flow of the liquid in the second space. This allows the apparatus to do the electrolysis of water and the generation of plasma with the water flowing. In other words, the apparatus can produce alkaline and acidic waters from flowing water. As a result, for example, large volumes of alkaline and acidic waters can be produced continuously.

In the above structure, the plasma generator may generate plasma while the liquid is flowing from the first inlet to the first outlet in the first space and from the second inlet to the second outlet in the second space.

This allows simultaneous production of alkaline and acidic waters. This means that it is possible to produce alkaline and acidic waters simultaneously even if water flows in each of the first and second spaces. Since alkaline and acidic waters can be produced from flowing water, large volumes of alkaline and acidic waters can be produced in a single operation.

In the above structure, the plasma generator may generate plasma while the liquid is retained in the first space and the second space.

Since the liquid is limited to move between the first and second spaces, a stable discharge and plasma generation can be occurred. Also, alkaline and acidic waters can be produced simultaneously.

In the above structure, the plasma generator may further comprise a gas feeder that supplies a gas into the liquid in the reactor such that the gas covers the first electrode or the second electrode.

Since this ensures an efficient discharge and plasma generation, alkaline and acidic waters can be produced efficiently.

The following describes some embodiments in detail with reference to drawings.

All of the following embodiments illustrate general or specific examples. Any value, shape, material, component, arrangement or connection of components, step, order of steps, or similar information mentioned in the following description of embodiments is for illustrative purposes and not intended to limit the present disclosure. The components mentioned in the following description of embodiments are optional components, unless they are specified in an independent claim representing the broadest concept.

Embodiment 1

1. Liquid Treatment Apparatus

This section describes the structure of a liquid treatment apparatus according to Embodiment 1 with reference to FIG. 1. FIG. 1 illustrates the structure of a liquid treatment apparatus 10 according to this embodiment.

As illustrated in FIG. 1, the liquid treatment apparatus 10 has a reactor 20, a partition 30, and a plasma generator 100. The liquid treatment apparatus 10 according to this embodiment produces alkaline and acidic waters simultaneously by generating plasma in flowing water.

1-1. Reactor

The reactor 20 is a vessel that forms a space 21 able to contain water 40. The space 21 is therefore a space enclosed by the inner surface of the reactor 20.

To be specific, the reactor 20 is an H-shaped cell. The H-shaped cell is composed of a pair of cylindrical tubes and a connecting tube that connects them. The inner diameter of the pair of tubes is, for example, 5 mm. The connecting tube is, for example, a cylindrical tube having an inner diameter of 10 mm. The connecting tube contains the partition 30. The capacity of the reactor 20 is 40 cc, and the length of the connecting tube is 48 mm. The shape of the connecting tube is not limited to a cylinder.

The space 21 is partitioned by the partition 30 into a first space 22 and a second space 23. The first space 22 is, for example, the space formed by the inner surface of the reactor 20 and one side of the partition 30, i.e., the space in the reactor 20 on the left side of FIG. 1. The second space 23 is, for example, the space formed by the inner surface of the reactor 20 and the other side of the partition 30, i.e., the space in the reactor 20 on the right side of FIG. 1.

In specific terms, one tube in the H-shaped cell and part of the connecting tube form the first space 22, and the other tube and part of the connecting tube form the second space 23. One tube is supplied with first water 41, and the other tube is supplied with second water 42. The first water 41 and the second water 42 are both drained from the reactor 20 without staying there.

The reactor 20 can be a vessel where water is retained, and can also be a thin tube where water can flow. The reactor 20 can have any size and any shape. For example, the reactor 20 can be part of a tank or tube. A liquid flows faster with decreasing diameter of the tube where it flows. If the partition separating the first space 22 and the second space 23 does not work sufficiently, therefore, water is likely to mix across the two spaces.

The reactor 20 is made of an acid- and alkali-resistant material. Examples of materials for the reactor 20 include plastic materials such as polyvinyl chloride, metallic materials such as stainless steel, and ceramic materials.

The reactor 20 has a first inlet 24, a second inlet 25, a first outlet 26, and a second outlet 27. The first inlet 24 is a part through which the first space 22 is supplied with water, and the second inlet 25 is a part through which the second space 23 is supplied with water. The first outlet 26 is a part through which the first space 22 is drained, and the second outlet 27 is a part through which the second space 23 is drained.

The reactor 20 is therefore supplied with water 40 through the first inlet 24 and the second inlet 25 and drained through the first outlet 26 and the second outlet 27. In this embodiment, the water 40 is, for example, tap water. The water 40 need not be purified water or distilled water, and can be an aqueous solution of predetermined substances.

The water 40 includes first water 41 and second water 42. The first water 41 flows through the first space 22 from the first inlet 24 toward the first outlet 26. The second water 42 flows through the second space 23 from the second inlet 25 toward the second outlet 27. The flow rate of the first water 41 and the second water 42 is, for example, 0.1 L/min or more and 1 L/min or less.

In specific terms, first water 41 is supplied into the first space 22 through the first inlet 24, and second water 42 is supplied into the second space 23 through the second inlet 25. The first water 41 in the first space 22 and the second water 42 in the second space 23 hardly mix because of the presence of the partition 30.

The plasma generator 100 produces alkaline water 43 from the first water 41. The plasma generator 100 also produces acidic water 44 from the second water 42. Water hardly mixes across the first space 22 and the second space 23. The alkaline water 43 produced from the first water 41 is therefore ejected through the first outlet 26. The acidic water 44 produced from the second water 42 is ejected through the second outlet 27.

1-2. Partition

The partition 30 partitions the space 21 into the first space 22 and the second space 23. The partition 30 allows ions or electrons to move between the first space 22 and the second space 23 and limits the movement of water molecules.

The partition 30 includes, for example, an ion-exchange membrane that allows cations or anions to pass through or an electron conductive membrane that allows electrons to pass through. To be specific, the partition 30 can be Nafion (Du Pont; "Nafion" is a registered trademark), Selemion (Asahi Glass; "Selemion" is a registered trademark), or an electroconductive plastic partition.

The partition 30 is attached to the inner surface of the connecting tube of the reactor 20. In specific terms, the partition 30 is placed with no space between it and the connecting tube. As a result, the movement of water molecules in the reactor 20 is substantially blocked.

The term "substantially blocked" means not only that the movement of water molecules is completely blocked, but also that slight movement of water molecules is allowed. The partition 30 includes therefore a membrane that has sufficiently high water pressure resistance. Note that narrowing the space where water flows increases the difference in pressure caused by the difference in flow rate between the first space 22 and the second space 23, making water more likely to mix across the spaces. The use of Selemion, for example, as the partition 30 leads to substantial blockage of the movement of water molecules even in such a case.

1-3. Plasma Generator

The plasma generator 100 has a first electrode 110, a second electrode 120, a power supply 130, and a gas feeder 140. As illustrated in FIG. 1, the first electrode 110 is at least partially located in the first space 22. The second electrode 120 is at least partially located in the second space 23.

The plasma generator 100 generates plasma 142 in the water 40. In specific terms, the plasma generator 100 produces plasma 142 near the second electrode 120 in the water 40 in the reactor 20. To be more specific, the plasma generator 100 produces a bubble 141 in the second water 42 in the second water 42 in the second space 23 and generates the plasma 142 in the bubble 141.

The first electrode 110 is one of the pair of electrodes the plasma generator 100 has. In specific terms, the first electrode 110 is a negative electrode to which the power supply 130 applies negative voltage. The first electrode 110 is, for example, a rod electrode. To be more specific, the first electrode 110 is a column having a diameter of, for example, 2 mm.

The first electrode 110 is at least partially located in the first space 22, not in the second space 23. As illustrated in FIG. 1, the first electrode 110 faces the second electrode 120 with the partition 30 therebetween.

The first electrode 110 can be made of an electroconductive metallic material. Examples of materials for the first electrode 110 include tungsten, copper, aluminum, and iron. It is desirable that the first electrode 110 be made of an alkali-resistant material.

The second electrode 120 is the other one of the pair of electrodes the plasma generator 100 has. In specific terms, the second electrode 120 is a positive electrode to which the power supply 130 applies positive voltage. The second electrode 120 is at least partially located in the second space 23, not in the first space 22.

The second electrode 120 is positioned somewhere not to the side of the connecting tube, for example. To be specific, the second electrode 120 is positioned to ensure that flowing water passes by the vicinity of the second electrode 120 after passing by the side of the connecting tube.

This is in order to prevent a bubble released near the second electrode 120 from entering the connecting tube. Entry of the bubble into the connecting tube leads to increased resistivity, interferes with the generation of plasma, and therefore inhibits the production of acidic and alkaline waters. In an extreme case, the connecting tube may be totally filled with a gas so that no plasma is generated.

Likewise, the first electrode 110 is positioned somewhere not to the side of the connecting tube. To be specific, the first electrode 110 is positioned to ensure that flowing water passes by the vicinity of the first electrode 110 after passing by the side of the connecting tube. The first electrode 110 produces microbubbles, mainly a hydrogen gas. Positioning the first electrode 110 to the side of the connecting tube can cause the same problem as with the second electrode 120.

If the first electrode 110 and the second electrode 120 are positioned near the connecting tube, this problem can be avoided by tilting the entire H-shaped cell. Allowing the entire H-shaped cell to swing like a pendulum also avoids the problem. The positions of the first electrode 110 and the second electrode 120 are therefore not limited to what is described above. The first electrode 110 can be positioned anywhere in the first space 22, and the second electrode 120 can be positioned anywhere in the second space 23.

The details of the structure of the second electrode 120 will be described hereinafter with reference to FIGS. 2 to 3B.

The power supply 130 applies a predetermined AC or pulse voltage to the first electrode 110 and the second electrode 120. The voltage applied is, for example, high-voltage pulses of 2 kV/cm to 50 kV/cm and 1 Hz to 100 kHz. The waveform of the voltage can be any of rectangular wave, a half-cycle sine wave, and a sine wave, for example. The value of the current between the first electrode 110 and the second electrode 120 is, for example, in the range of 1 mA to 3 A. In specific terms, the power supply 130 applies a pulse voltage with a peak voltage of 4 kV, a pulse width of 1 μs, and a frequency of 30 kHz. The electric power input from the power supply 130 is, for example, 30 W.

A rectifier 131, such as a diode, is connected to the power supply 130. This ensures that the power supply 130 applies positive voltage to the second electrode 120 and negative voltage to the first electrode 110. The second electrode 120 is therefore the positive electrode, and the first electrode 110 is the negative electrode.

The situation where "the power supply applies AC or pulse voltage to the first and second electrodes" herein includes a situation where only one of positive and negative voltages is applied to the first or second electrode as a result of a rectifier rectifying the voltage output from the power supply. In other words, the term "AC or pulse voltage" as mentioned herein is a general term that refers to any kind of voltage whose magnitude and/or direction (positive or negative) cyclically change with time.

In this way, AC or pulse voltage is applied to the first electrode 110 and the second electrode 120. Applying DC voltage (a voltage whose magnitude and direction do not change with time) to the first electrode 110 and the second electrode 120 generally leads to an extremely small resistivity of the water as compared with that of the gas phase in the water. Even a minimum path of water existing between the pair of electrodes during an electric discharge in the gas phase therefore leads to leakage current. The leakage current reduces the current density in the gas phase between the pair of electrodes, making stable discharges impossible. Applying AC or pulse voltage as in the present disclosure, however, provides a situation equivalent to a flow of current in the gas phase in the water. The principle of the charge and discharge of a capacitor explains this. The use of an AC or pulse power supply as compared with a DC power supply therefore limits the impact of leakage current and allows for stable discharges.

If the partition 30 is an ion-exchange or electron conductive membrane that has much higher resistance than the water does, furthermore, applying DC voltage does not result in a flow of electric current between the first space 22 and the second space 23. Applying AC or pulse voltage as in the present disclosure, however, provides a situation equivalent to a flow of current in the ion-exchange or electron conductive membrane.

The gas feeder 140 supplies a gas to make the second electrode 120 covered with the gas. For example, the gas feeder 140 produces a bubble 141 in the second space 23 by supplying a gas to the vicinity of the second electrode 120. An example of the gas feeder 140 is a pump. The gas feeder 140, for example, takes in the surrounding air and supplies the air taken. Alternatively, the gas feeder 140 may supply argon, helium, an oxygen gas, or similar.

2. Structure of Electrodes

Figure 2:
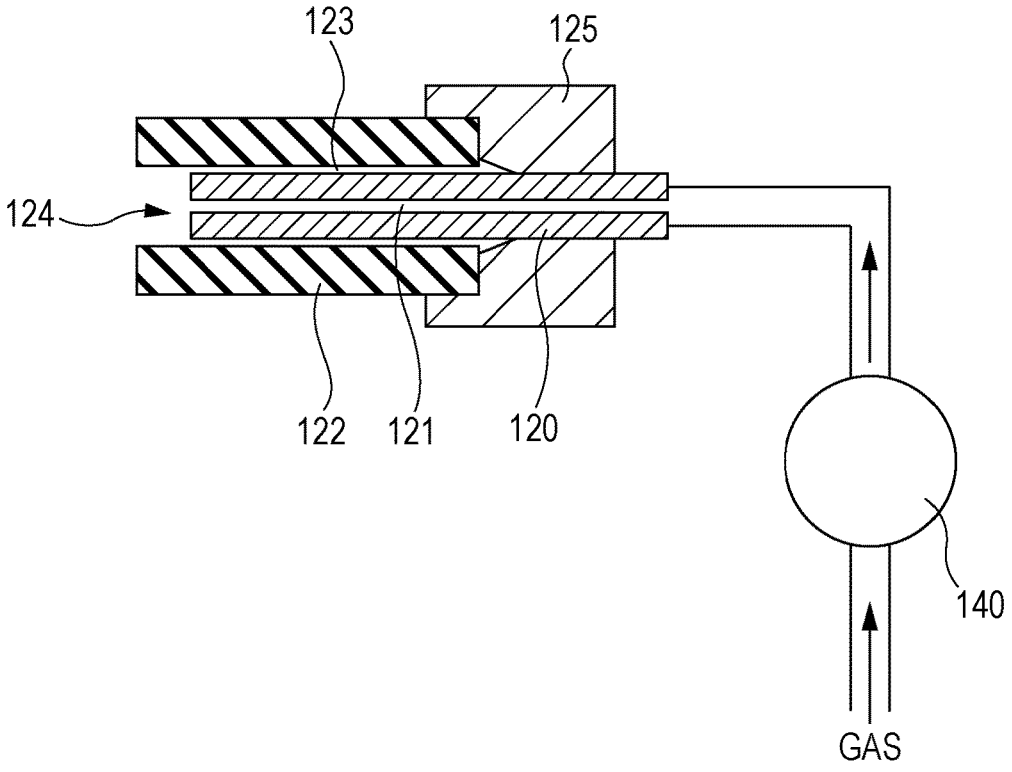
FIG. 2 illustrates the structure of a second electrode and an insulator in a liquid treatment apparatus according to Embodiment 1.
Figure 3A:
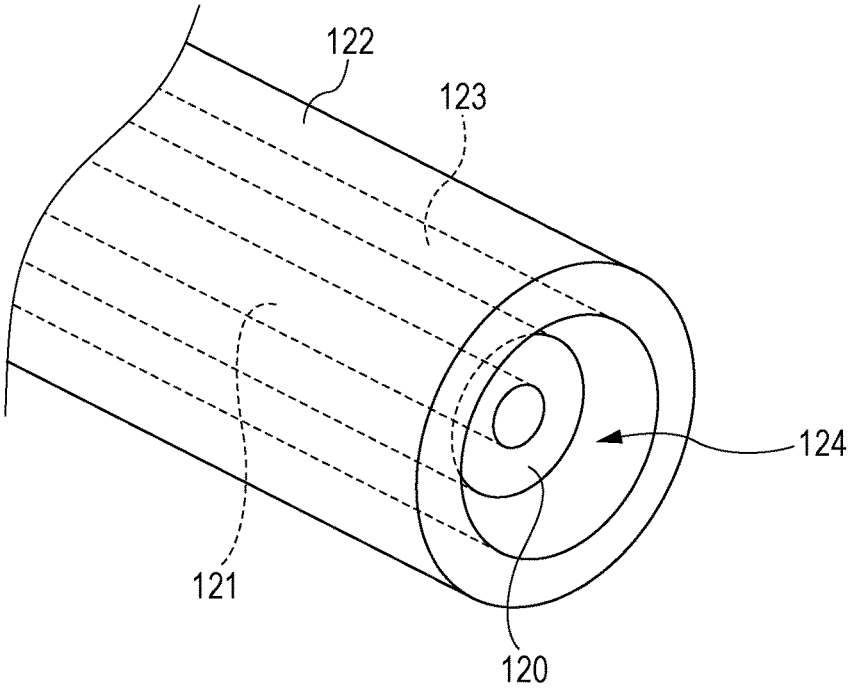
FIG. 3A is a perspective view of the second electrode and the insulator in the liquid treatment apparatus according to Embodiment 1.
Figure 3B:
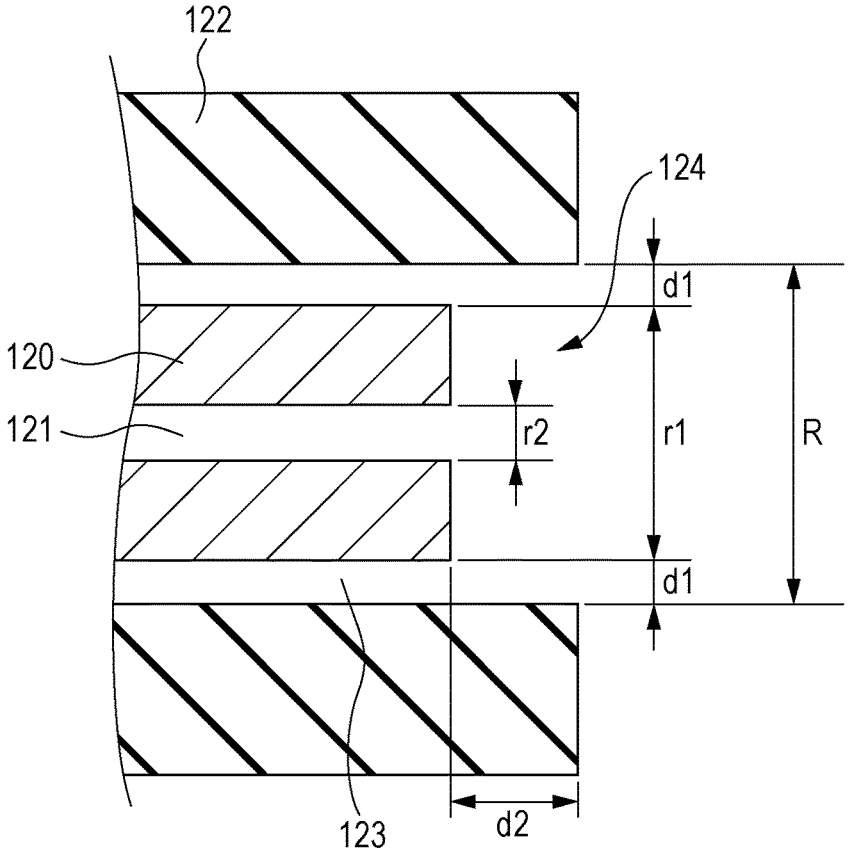
FIG. 3B is a cross-sectional view of the second electrode and the insulator in the liquid treatment apparatus according to Embodiment 1.

This section describes the details of the structure of the electrodes of a plasma generator 100 according to this embodiment with reference to FIGS. 2 to 3B.

FIG. 2 illustrates the structure of a second electrode 120 and an insulator 122 in the liquid treatment apparatus 10 according to this embodiment. FIGS. 3A and 3B are perspective and cross-sectional views, respectively, of the second electrode 120 and the insulator 122 in the liquid treatment apparatus 10 according to this embodiment.

As illustrated in FIG. 2, a plasma generator 100 according to this embodiment has a second electrode 120, an insulator 122, and a holding block 125. The second electrode 120 is located in the cylindrical insulator 122 with a gap 123. The second electrode 120 and the insulator 122 are held by the holding block 125.

2-1. Second Electrode

The second electrode 120 is a tubular electrode having a void 121. To be more specific, the second electrode 120 is a cylinder as illustrated in FIG. 3A. The outer diameter of the second electrode 120 (r1 in FIG. 3B) is, for example, 2 mm or less, an example being 2 mm.

The second electrode 120 is enclosed in the insulator 122, with a gap 123 between the second electrode 120 and the insulator 122. The second electrode 120 is held by the holding block 125.

One end of the second electrode 120 is in contact with the second water 42 in the second space 23, and the other is connected to the gas feeder 140. The gas supplied by the gas feeder 140 is guided through the void 121 of the second electrode 120 and released from the distal end of the second electrode 120. The released gas enters the gap 123 and covers the second electrode 120. The supplied gas is also guided through the opening 124 of the insulator 122 and released into the second water 42 in the form of a bubble 141. If no gas is supplied, the distal end of the second electrode 120 is covered with the second water 42. Once a gas is supplied, however, the distal end of the second electrode 120 is covered with a bubble 141, not in contact with the second water 42.

The second electrode 120 is used as a reaction electrode, around which plasma 142 is generated. To be specific, the generated plasma 142 is present in the bubble 141.

The second electrode 120 can be made of an electroconductive metallic material, such as a plasma-resistant metallic material. A specific example of a material for the second electrode 120 is tungsten, but any other plasma-resistant metallic material may also be used for the second electrode 120. Alternatively, the second electrode 120 may be made of copper, aluminum, iron, or an alloy of them, although these materials are less durable. It is, however, desirable that the second electrode 120 be made of an acid-resistant material.

The second electrode 120 may have a coating of a mixture of yttrium oxide and an electroconductive substance formed through thermal spraying on part of its surface. The electroconductive substance is, for example, metallic yttrium, and blending an electroconductive substance provides the mixture with an electroconductivity of 1 to 30 Ω·cm. This process of thermal spraying with yttrium oxide advantageously extends the service life of the electrode.

The void 121 is a through-hole that extends through the second electrode 120 in the axial direction. The diameter of the void 121, i.e., the inner diameter of the second electrode 120 (r2 in FIG. 3B), is, for example, 0.9 mm or less, an example being 0.3 mm. There may be one or more through-holes that extend from the void 121 through the side of the second electrode 120.

The second electrode 120 may be a polygonal tube. The cross-sectional shape of the void 121 (perpendicular to the axial direction of the tube) need not be round, and may be oval, rectangular, or similar.

2-2. Insulator

The insulator 122 encloses the second electrode 120 with a gap 123 between it and the second electrode 120. The gap 123 communicates with the void 121. The insulator 122 also has an opening 124 that connects the second space 23 and the gap 123. In this way, the insulator 122 electrically insulates the second electrode 120 from the second water 42.

In practice, the second electrode 120 is in contact with the second water 42 because the second water 42 flows into the insulator 122 through the opening 124. Once the gas feeder 140 supplies a gas, however, the gas blocks the opening 124 and makes the second electrode 120 electrically insulated from the second water 42.

The insulator 122 is, for example, a cylinder as illustrated in FIG. 3A. In a possible structure, the second electrode 120 is positioned in a cylindrical insulator 122 in such a manner that the axial direction of the second electrode 120 and that of the insulator 122 are parallel. To be specific, the insulator 122 and the second electrode 120 are arranged in such a manner that the second electrode 120 and the insulator 122 are coaxial.

The inner diameter of the insulator 122, i.e., the diameter of the opening 124 (R in FIG. 3B), is, for example, 3 mm or less, an example being 2 mm. The outer diameter of the insulator 122 is not limited. However, an outer diameter of 1 mm or less, for example, allows for size reduction.

The insulator 122 can be made of, for example, ceramic alumina. Alternatively, the insulator 122 may be made of magnesia, quartz, yttrium oxide, or similar.

The gap 123 is what is called a microgap. The distance the gap 123 makes (d1 in FIG. 3B) is based on, for example, the electron temperature and reduced electric field of the plasma and the density of the gas as the medium. For example, the distance d1 can be 0.5 mm or less.

The end face of the second electrode 120 is located a predetermined distance (distance d2 in FIG. 3B) back from that of the insulator 122. The distance d2 is, for example, less than 7 mm, desirably 3 mm or more and 5 mm or less.

Ensuring the end face of the second electrode 120 is located back from that of the insulator 122 helps the gas released from the distal end of the void 121 enter the gap 123, not only going out into the second space 23 through the opening 124. With the gap 123 filled with the gas, an electric discharge in the gap 123 can be initiated through the application of voltage.

The insulator 122 need not be cylindrical, and may be a polygonal tube. The insulator 122, held by the holding block 125 in the above structure, may be fastened to a wall of the reactor 20 instead, and may also be detachably attached.

The gap 123 between the insulator 122 and the second electrode 120 is not essential. In other words, the insulator 122 and the second electrode 120 may be in intimate contact with each other.

2-3. Holding Block

The holding block 125 holds the second electrode 120 and the insulator 122. The holding block 125 may be fastened to the reactor 20, for example. The holding block 125 may be integral with or separate from the reactor 20.

3. Operation

Figure 4:
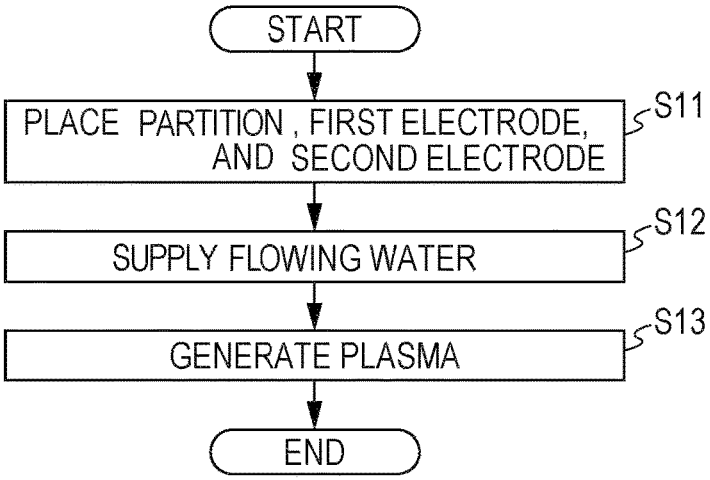
FIG. 4 is a flow chart illustrating the operation of the liquid treatment apparatus according to Embodiment 1.

This section describes the operation of the liquid treatment apparatus 10 according to this embodiment with reference to FIG. 4. FIG. 4 is a flow chart illustrating the operation of the liquid treatment apparatus 10 according to this embodiment.

First, a partition 30, a first electrode 110, and a second electrode 120 are placed in the space 21 of a reactor 20 (S11). To be specific, a partition 30 that partitions the space 21 into a first space 22 and a second space 23 is placed in the space 21. The partition 30 allows ions or electrons to move between the first space 22 and the second space 23 and substantially blocks the movement of water molecules. A first electrode 110 is then placed in the first space 22, and a second electrode 120 is placed in the second space 23.

The space 21 is then supplied with flowing water (S12). In other words, water 40 is passed through the space 21. To be specific, the first space 22 is supplied with first water 41 through a first inlet 24 and drained through a first outlet 26. A flow of first water 41 is therefore formed in the first space 22 in the direction from the first inlet 24 toward the first outlet 26. Likewise, the second space 23 is supplied with second water 42 through a second inlet 25 and drained through a second outlet 27. A flow of second water 42 is therefore formed in the second space 23 in the direction from the second inlet 25 toward the second outlet 27.

It is also possible to supply water 40 (S12) first and then place a partition 30 and other components (S11).

Furthermore, the operation may start with supplying flowing water (S12) into a reactor 20 in which a partition 30, a first electrode 110, and a second electrode 120 are already in place. In other words, the entity that places a partition 30, a first electrode 110, and a second electrode 120 in the space 21 (S11) may be different from the entity that supplies the space 21 with flowing water (S12).

Then a plasma generator 100 generates plasma 142 in the water 40 (S13). In specific terms, plasma 142 is generated in the water 40 through the application of AC or pulse voltage between the first electrode 110 and the second electrode 120, which produces alkaline water 43 from the first water 41 and acidic water 44 from the second water 42.

To be more specific, a gas feeder 140 first supplies a gas into the second space 23 to make the second electrode 120 covered with the gas. A power supply 130 then applies pulse voltage between the first electrode 110 and the second electrode 120. A discharge initiated in a bubble 141 forming near the second electrode 120 generates plasma 142.

The first water 41, the partition 30, the second water 42, and the plasma 142 in the bubble 141 form a current path between the first electrode 110 and the second electrode 120. The resulting electrolysis of each of the first water 41 and the second water 42 produces alkaline water 43 from the first water 41 and acidic water 44 from the second water 42.

In the first space 22, water flows in the direction from the first inlet 24 toward the first outlet 26. The produced alkaline water 43 is therefore ejected through the first outlet 26. In the second space 23, likewise, water flows in the direction from the second inlet 25 toward the second outlet 27. The produced acidic water 44 is therefore ejected through the second outlet 27.

In this embodiment, therefore, the space 21 is partitioned into a first space 22 and a second space 23. A first electrode 110 is placed in the first space 22, and a second electrode 120 is placed in the second space 23. Plasma 142 is then generated through the application of voltage between the electrodes. As a result, alkaline water 43 is produced from first water 41 in the first space 22, and acidic water 44 is produced from second water 42 in the second space 23.

4. Experimental Results

Figure 5:
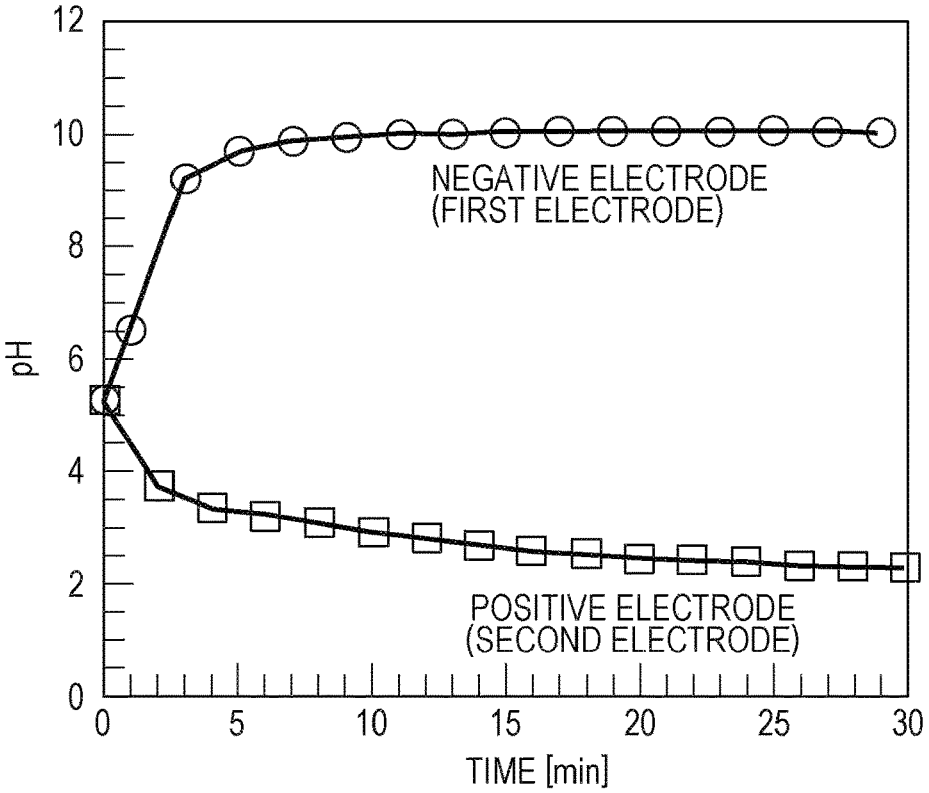
FIG. 5 illustrates pH values in a liquid treatment apparatus according to Embodiment 1 as measured near the first and second electrodes.
Figure 6A:
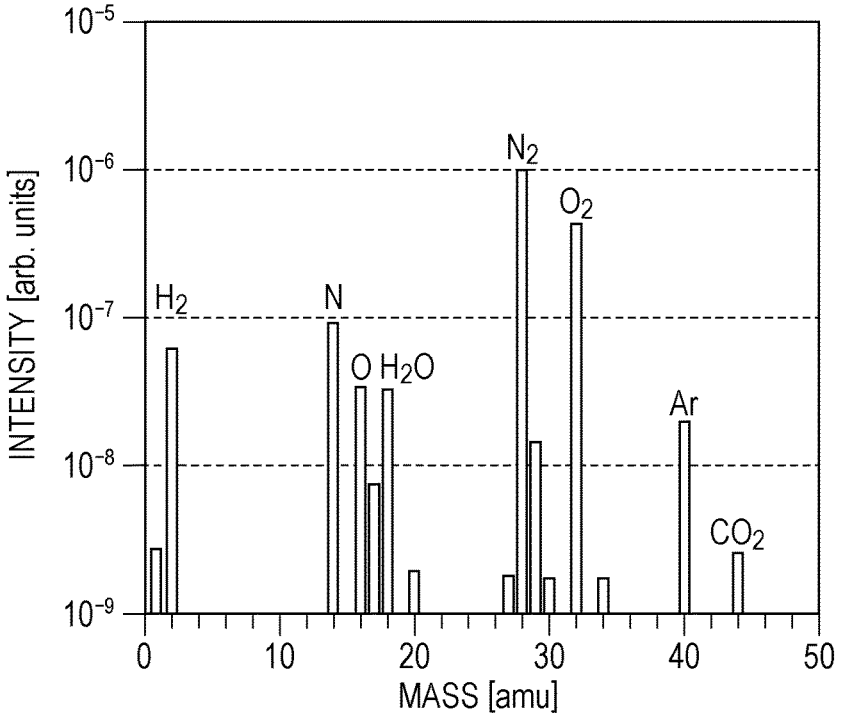
FIG. 6A illustrates substances generated near the positive electrode in a liquid treatment apparatus according to Embodiment 1.
Figure 6B:
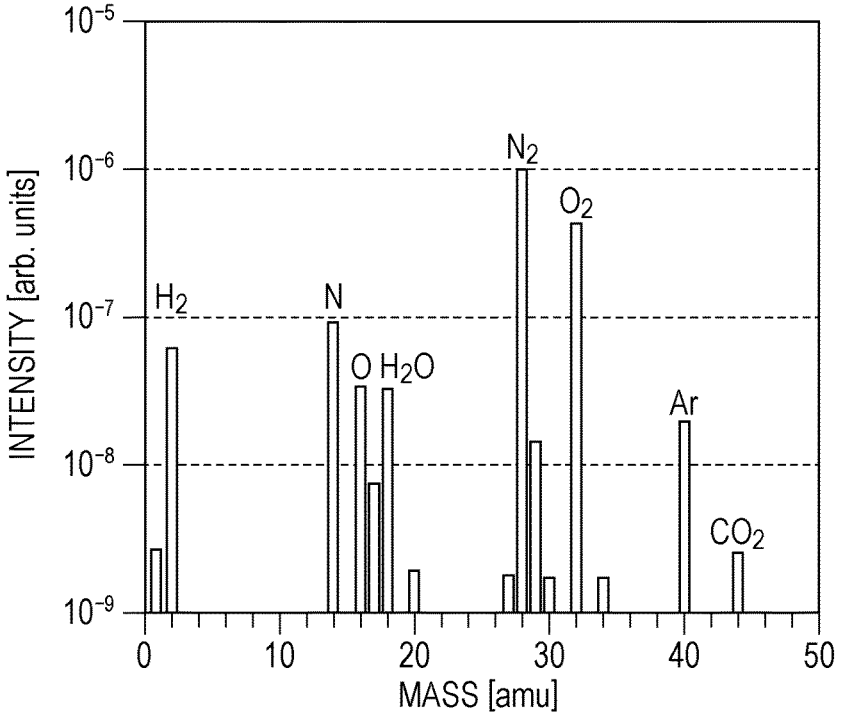
FIG. 6B illustrates substances generated near the negative electrode in a liquid treatment apparatus according to Embodiment 1.

This section describes, with reference to FIGS. 5 to 6B, the results of a water treatment process performed using a liquid treatment apparatus 10 according to this embodiment.

FIG. 5 illustrates the time-course of pH in water measured near each of the first electrode 110 and the second electrode 120 in the liquid treatment apparatus 10 according to this embodiment. The horizontal axis is the time from the start of voltage application. FIG. 5 presents measurements at a water flow rate of 0.6 L/min.

As can be seen from FIG. 5, pH decreased near the second electrode 120 as the positive electrode with the start of voltage application, i.e., with the start of the generation of plasma through an electric discharge, demonstrating that acidic water 44 was produced from the second water 42. To be specific, the reaction of formula 1 occurred near the second electrode 120.

$$2H_2O \rightarrow O_2 + 4H^+ + 4e^- \quad \text{(Formula 1)}$$

In this way, the second water 42 is decomposed into oxygen, hydrogen ions, and electrons. The generated hydrogen ions produce acidic water 44 near the second electrode 120. The results in FIG. 5 indicate that acidic water 44 was produced with a pH of approximately 2.

Plasma 142 is generated near the second electrode 120. The plasma 142 produces active species such as hydrogen peroxide and hydroxy radicals.

Near the first electrode 110 as the negative electrode, pH increased. This demonstrates that alkaline water 43 was produced from the first water 41. To be specific, the reaction of formula 2 occurred near the first electrode 110.

$$4H_2O + 4e^- \rightarrow 2H_2 + 40H^- \quad \text{(Formula 2)}$$

In this way, the first water 41 is decomposed into hydrogen and hydroxide ions. The generated hydroxide ions produce alkaline water 43 near the first electrode 110. The results in FIG. 5 indicate that alkaline water 43 was produced with a pH of approximately 10.

As can be seen from the foregoing, the liquid treatment apparatus 10 according to this embodiment is able to produce alkaline water 43 and acidic water 44 simultaneously. The produced alkaline water 43 and acidic water 44 can be used for, for example, dirt removal.

Note that in the liquid treatment apparatus 10 according to this embodiment, a hydrogen gas also occurs on the second electrode 120 (positive electrode) side, suggesting that part of the reaction of formula 2 occurs in the second space 23. This should be because a gas-liquid interface formed by the bubble 141 serves as a negative electrode. The hydrogen gas produced on the second electrode 120 side is released in the form of microbubbles. In the space near the second electrode 120, therefore, it is possible to produce a hydrogen gas and microbubbles containing it while producing alkaline water.

FIGS. 6A and 6B illustrate substances that formed on the positive electrode (second electrode 120) and negative electrode (first electrode 110), respectively, in a liquid treatment apparatus 10 according to this embodiment. The horizontal axis is the atomic mass unit, and the vertical axis represents the relative signal intensity in mass spectrometry. As can be seen from FIGS. 6A and 6B, a hydrogen gas ($H_2$) was produced on both positive and negative electrodes in this embodiment.

5. Dirt Removal

Figure 7:
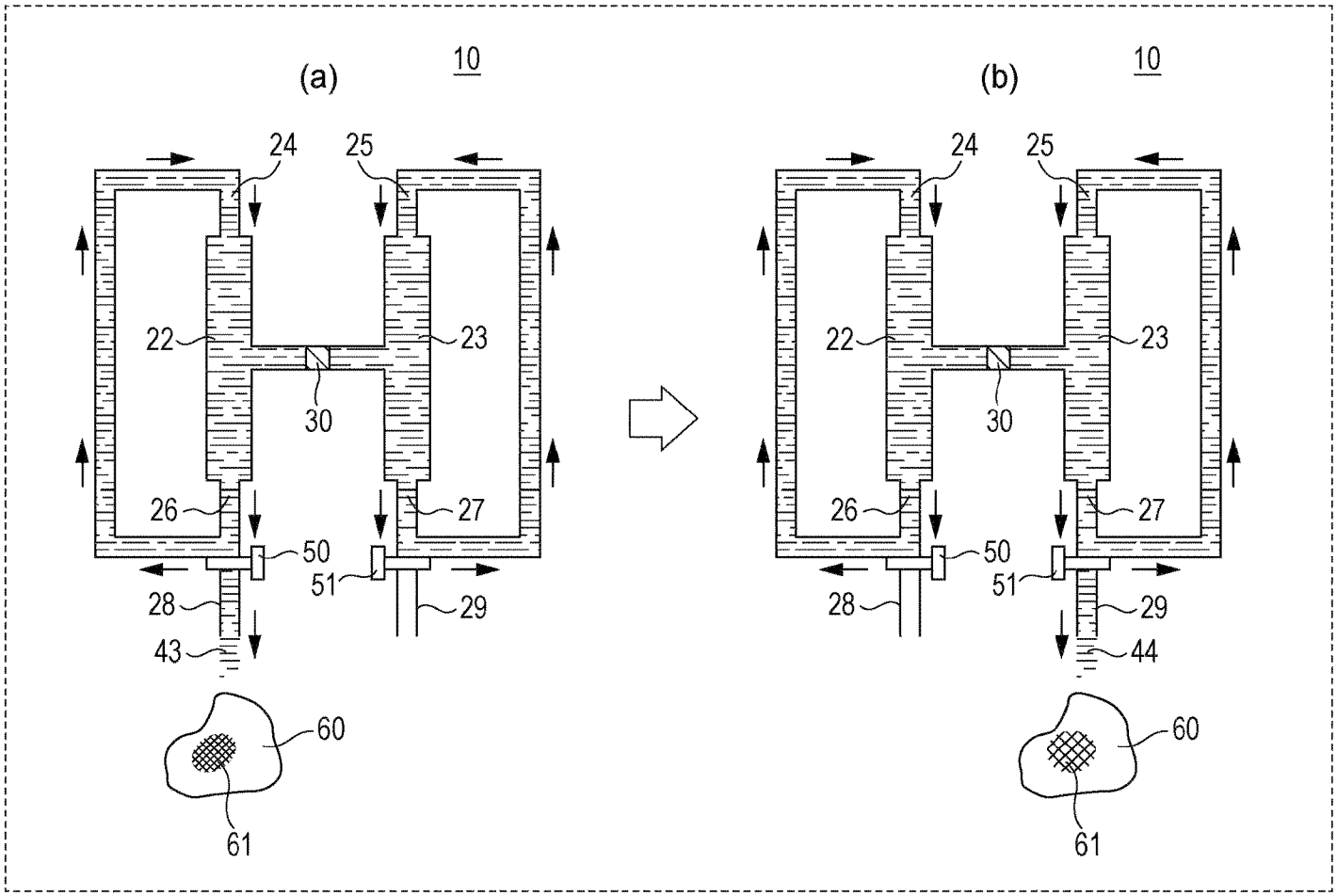
FIG. 7 schematically illustrates a removal of dirt with a liquid treatment apparatus according to Embodiment 1.
Figure 8:
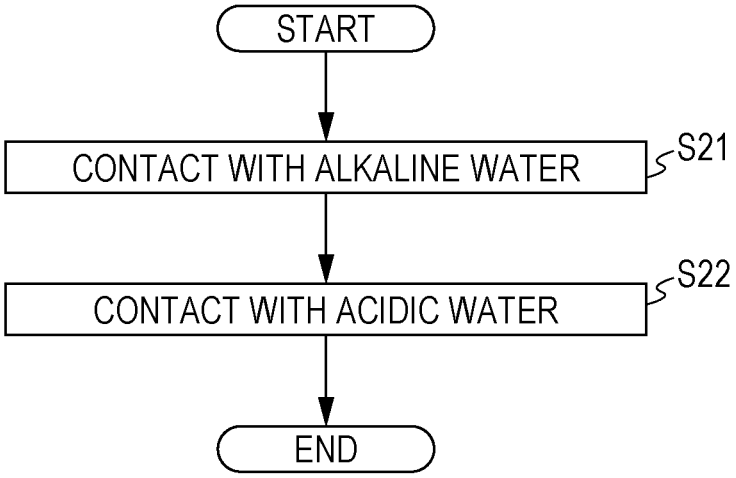
FIG. 8 is a flow chart illustrating a method for removing dirt using a liquid treatment apparatus according to Embodiment 1.

This section describes a method for removing dirt using a liquid treatment apparatus 10 according to this embodiment with reference to FIGS. 7 and 8. FIG. 7 schematically illustrates a removal of dirt with a liquid treatment apparatus 10 according to this embodiment. FIG. 8 is a flow chart illustrating the method for removing dirt using a liquid treatment apparatus 10 according to this embodiment.

As mentioned above, the liquid treatment apparatus 10 ejects alkaline water 43 through the first outlet 26 and acidic water 44 through the second outlet 27. Bringing the alkaline water 43 and the acidic water 44 into contact with a subject of treatment removes the dirt from the subject.

In this embodiment, the first outlet 26 and the first inlet 24 are, for example, connected with piping or similar as illustrated in FIG. 7. The first outlet 26, the piping, the first inlet 24, and the first space 22 form a circulation path through which the first water 41 and the alkaline water 43 circulate. Likewise, the second outlet 27 and the second inlet 25 are connected with piping or similar. The second outlet 27, the piping, the second inlet 25, and the second space 23 form a circulation path through which the second water 42 and the acidic water 44 circulate. Water can be circulated through, for example, the use of a pump or any other liquid feeder placed in the circulation paths.

The first outlet 26 and the second outlet 27 have branch tubes 28 and 29, respectively, that extend out from the circulation paths. The branch tubes 28 and 29 have valves 50 and 51, respectively, that the user can open and close at any time. The user can take out the alkaline water 43 or acidic water 44 for use by opening and closing the valve 50 or 51.

In this embodiment, therefore, alkaline water 43 and acidic water 44 are produced from circulating water. A decrease in the quantity of water in the circulating paths associated with the consumption of alkaline water 43 or acidic water 44 can be compensated for through the addition of water on an as-needed basis. This allows, for example, semi-permanent continuous production and use of alkaline water 43 and acidic water 44.

A description of the method for removing a stain is as follows. First, a subject of treatment 60 including dirt 61 is brought into contact with alkaline water 43 (S21). For example, the valve 50 is opened to release alkaline water 43 through the branch tube 28 of the first outlet 26 as illustrated in FIG. 7 (*a*). The subject of treatment 60 is brought into contact with the released alkaline water 43.

The subject of treatment 60 can be any of a gas, a liquid, and a solid. For example, the subject of treatment is a piece of kitchenware, such as a dish or a cooking utensil. The dirt 61 is an insoluble matter, such as grease, a tea stain, or slime. When the subject of treatment 60 is brought into contact with alkaline water 43, the dirt 61 is detached from the subject of treatment 60 by the alkaline water 43.

Then the subject of treatment 60 is brought into contact with acidic water 44 (S22). For example, the valve 51 is opened to release acidic water 44 through the branch tube 29 of the second outlet 27 as illustrated in FIG. 7 (*b*). The subject of treatment 60 is brought into contact with the released acidic water 44.

As a result, the dirt 61 detached from the subject of treatment 60 is decomposed and removed by the acidic water 44.

If the dirt 61 is a water-soluble substance, the contact with alkaline water 43 is unnecessary, and the contact with acidic water 44 alone is enough to decompose and remove the dirt 61. The acidic water 44 contains active species produced by the plasma 142, such as hydrogen peroxide and hydroxy radicals. These active species accelerate the actions involved in the removal of the dirt 61, such as decomposition and disinfection, making the dirt removal process shorter and faster.

6. Advantages and Other Information

In conclusion, the liquid treatment apparatus 10 according to this embodiment comprises the reactor 20 and the plasma generator 100. The reactor 20 includes the inner wall, the first space 22, and the second space 23. The inner wall includes an inner surface of the reactor 20 and a surface of the partition 20. Each of the first space 22 and the second space 23 is capable of containing water 40. The water 40 is suppressed to move between the first space 22 and the second space 23. The inner wall allows ions or electrons to move between the first space 22 and the second space 23. The liquid treatment apparatus 10 also comprises the plasma generator 100 which includes the first electrode 110 at least partially located in the first space 22, the second electrode 120 at least partially located in the second space 23, and the power supply 130 that applies AC or pulse voltage between the first electrode 110 and the second electrode 120. The plasma generator 100 produces plasma in the water 40.

This structure, in which ions or electrons are able to move between the first space 22 and the second space 23, ensures a current path involving the partition 30 is formed between the first space 22 and the second space 23, allowing for the electrolysis of water and the generation of plasma.

The substantial blockage of the movement of water molecules prevents the electrolytically produced alkaline water 43 and acidic water 44 from mixing. The liquid treatment apparatus 10 according to this embodiment therefore allows simultaneous production of alkaline water 43 and acidic water 44.

In this embodiment, it is possible to perform electrolysis and the generation of plasma in flowing water. As a result, large volumes of alkaline and acidic waters can be produced continuously.

Figure 9:
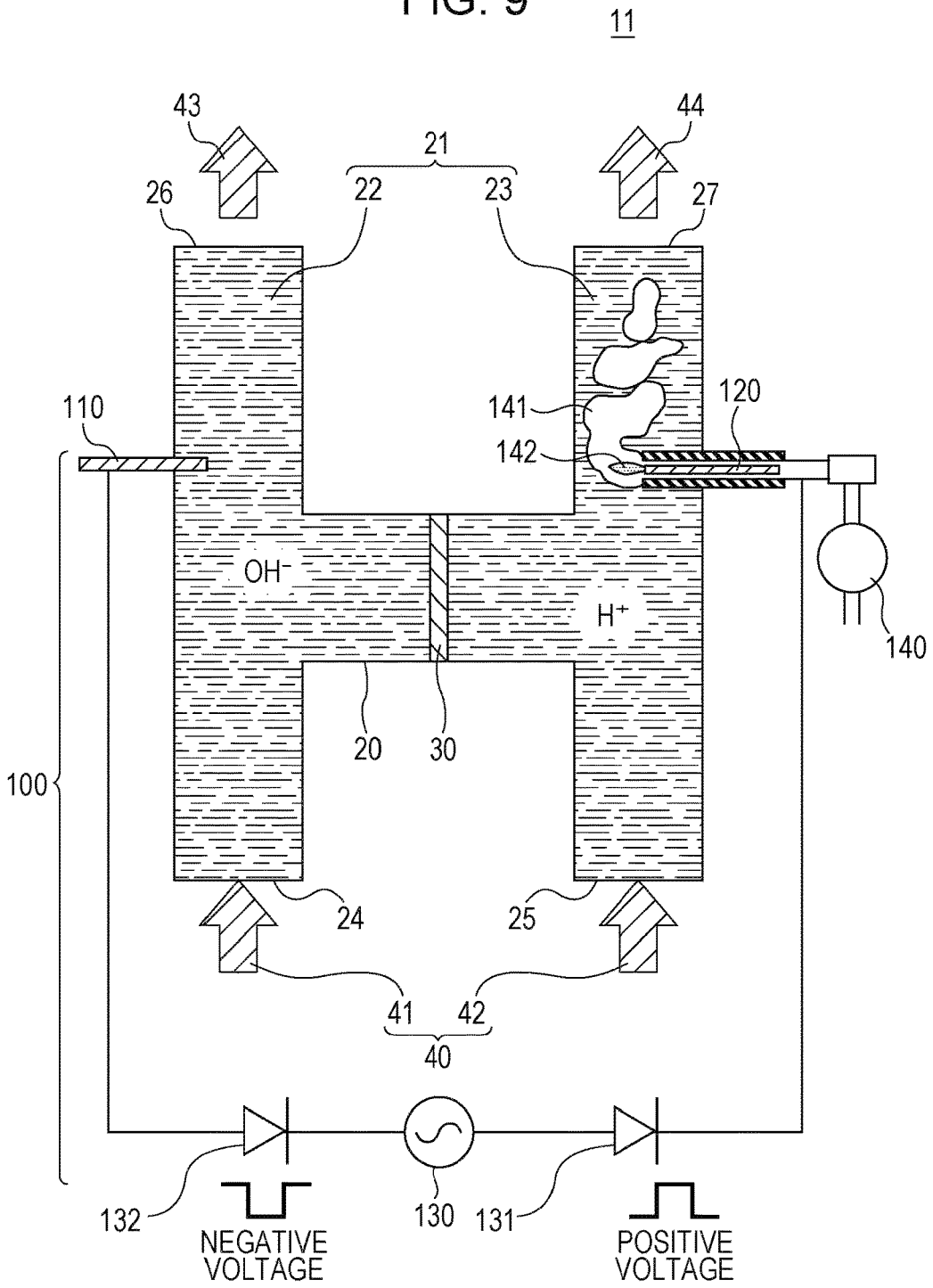
FIG. 9 illustrates another structure of a liquid treatment apparatus according to Embodiment 1.

The liquid treatment apparatus 10 according to this embodiment has, as illustrated in FIG. 1, a rectifier 131 between the power supply 130 and the second electrode 120. However, there may be a rectifier 132 between the power supply 130 and the first electrode 110 as in the liquid treatment apparatus 11 illustrated in FIG. 9. This allows the power supply 130 to apply positive voltage to the second electrode 120 and negative voltage to the first electrode 110.

In this embodiment, the reactor is exemplified by a reactor 20. The liquid is exemplified by water 40. The plasma generator is exemplified by a plasma generator 100 including a first electrode 110, a second electrode 120, and a power supply 130. The inner wall conductive to ions or electrons that move between the first and second spaces is exemplified by a partition 30.

Variation

The section describes a variation of the liquid treatment apparatus 10 according to Embodiment 1.

Figure 10:
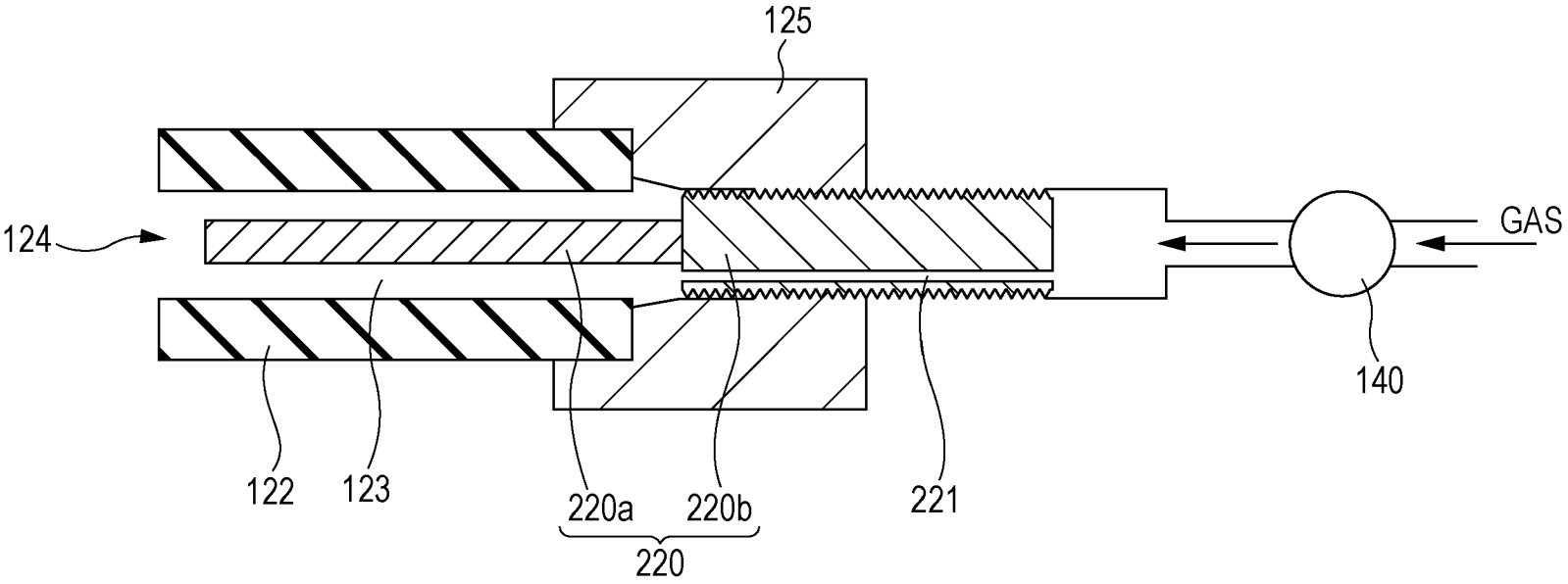
FIG. 10 illustrates the structure of a second electrode and an insulator in a liquid treatment apparatus according to a variation of Embodiment 1.

The liquid treatment apparatus according to this variation is different in terms of the structure of electrodes in the plasma generator. To be specific, the plasma generator according to this variation has a second electrode 220 illustrated in FIG. 10 instead of the second electrode 120. FIG. 10 illustrates the structure of the second electrode 220 and an insulator 122 in the liquid treatment apparatus according to this variation.

The following description focuses on its differences from that according to Embodiment 1.

The second electrode 220 has a metallic electrode section 220*a* and a metallic screw section 220*b*.

The metallic electrode section 220*a* is, for example, a columnar metallic electrode. The diameter of the metallic electrode section 220*a* is, for example, 2 mm or less, an example being 0.95 mm.

The metallic electrode section 220*a* is enclosed in an insulator 122. There is a gap 123 between the metallic electrode section 220*a* and the insulator 122.

One end of the second electrode section 220*a* is in contact with the second water 42, and the other is in the metallic screw section 220*b* as a result of a press fit. The metallic electrode section 220*a* does not extend outward beyond the opening 124 of the insulator 122.

The metallic electrode section 220*a* is used as a reaction electrode, around which plasma 142 is generated. Examples of materials for the metallic electrode section 220*a* are the same as those for the second electrode 120.

The metallic screw section 220*b* is, for example, a rod-shaped component. To be specific, the metallic screw section 220*b* is a column. The metallic screw section 220*b* has, for example, a diameter greater than that of the metallic electrode section 220*a*, an example being 3 mm.

The metallic screw section 220*b* is made of, for example, iron. Common materials for screws, such as copper, zinc, aluminum, tin, and brass, can also be used for the metallic screw section 220*b*. The metallic screw section 220*b* and the metallic electrode section 220*a* may be made of the same material and in the same size. The second electrode 220 can therefore be a single rod.

The metallic screw section 220*b* has a through-hole 221 connected to the gas feeder 140. The through-hole 221 extends through the metallic screw section 220*b* in the axial direction.

The through-hole 221 communicates with the gap 123. The gas supplied by the gas feeder 140 is guided through the through-hole 221 to the gap 123. The gas supplied to the gap 123 is released into the second space 23 through the opening 124. The through-hole 221 has, for example, a diameter of 0.3 mm.

The outer circumference of the metallic screw section 220*b* has a screwed portion. The screwed portion is, for example, a male screw that fits into a screwed portion of the holding block 125.

Although the insulator 122 and the holding block 125 in this variation are substantially the same as those in Embodiment 1, they may have a different shape. For example, an insulator 122 according to this variation may have a shape modified in accordance with the diameter of the metallic electrode section 220*a*. If the diameter of the metallic electrode section 220*a* is smaller than that of the second electrode 120 according to Embodiment 1, for example, it is possible to change the shape of the insulator 122 to ensure that the distance the gap 123 makes is equal to that in Embodiment 1.

Embodiment 2

The following describes Embodiment 2.

1. Liquid Treatment Apparatus

Figure 11:
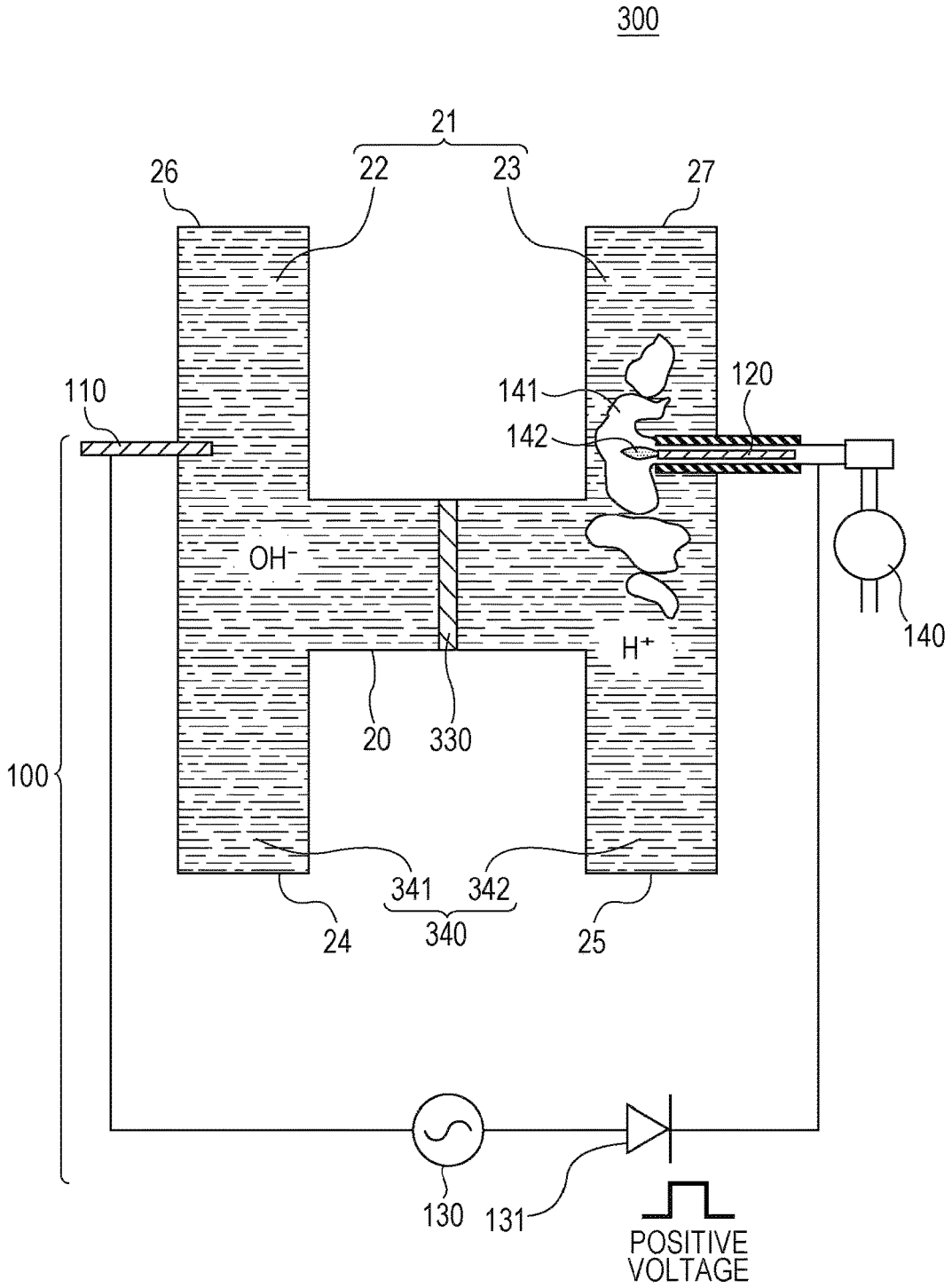
FIG. 11 illustrates the structure of a liquid treatment apparatus according to Embodiment 2.

This section describes the structure of a liquid treatment apparatus according to this embodiment. FIG. 11 illustrates the structure of a liquid treatment apparatus 300 according to this embodiment.

As illustrated in FIG. 11, the liquid treatment apparatus 300 is different from the liquid treatment apparatus 10 according to Embodiment 1 in FIG. 1 in that it has a partition 330 instead of the partition 30. The following description focuses on differences.

1-1. Static Water

In the liquid treatment apparatus 300 according to this embodiment, the reactor 20 is able to contain water 340. In Embodiment 1, plasma is generated while water is flowing, but in this embodiment, plasma is generated while water is not flowing. In other words, plasma is generated in static water.

The water 340 is supplied through the first inlet 24 or the second inlet 25 and retained in the reactor 20. The water 340 hardly flows in the reactor 20. To be specific, the reactor 20 is supplied with water through the first inlet 24 or the second inlet 25 with the first outlet 26 and the second outlet 27 closed. Then the convection in the water 340 in the reactor 20 subsides with time.

The water 340 is, for example, tap water. The water 340 need not be purified water or distilled water, and can be an aqueous solution of predetermined substances.

In specific terms, the water 340 includes first water 341 and second water 342. The first water 341 is supplied through the first inlet 24 and retained in the first space 22. The second water 342 is supplied through the second inlet 25 and retained in the second space 23.

1-2. Partition

The partition 330 partitions the space 21 able to contain water 340 into the first space 22 and the second space 23. The partition 330 allows ions or electrons to move between the first space 22 and the second space 23 and suppresses the movement of water molecules. To be specific, the partition 330 may allow water molecules to pass through, but not freely.

For example, the partition 330 is a porous partition. In specific terms, the partition 330 is made of a porous ceramic material or porous glass.

The partition 330 is attached to the inner surface of the reactor 20. For example, the partition 330 is placed with no space between it and the reactor 20. As a result, water molecules cannot pass through the partition 330 in the reactor 20 and, therefore, cannot move between the first space 22 and the second space 23.

2. Operation

Figure 12:
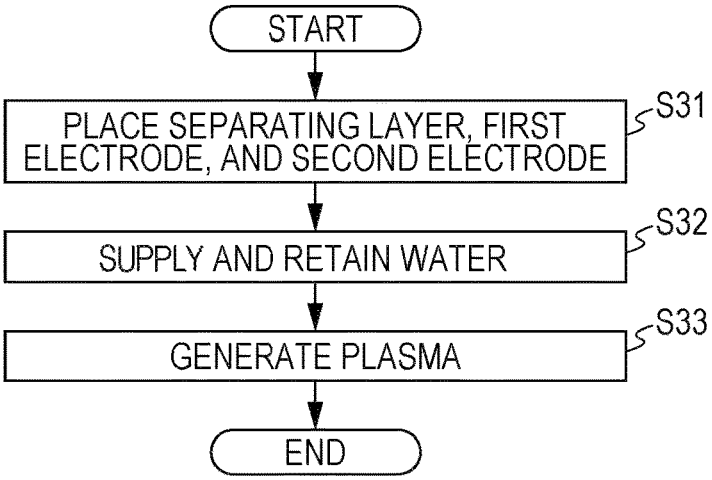
FIG. 12 is a flow chart illustrating the operation of a liquid treatment apparatus according to Embodiment 2.

This section describes the operation of the liquid treatment apparatus 300 according to this embodiment with reference to FIG. 12. FIG. 12 is a flow chart illustrating the operation of the liquid treatment apparatus 300 according to this embodiment.

First, a partition 330, a first electrode 110, and a second electrode 120 are placed in the space 21 of a reactor 20 (S31). To be specific, a partition 330 is placed in the space 21 to partition the space 21 into a first space 22 and a second space 23. The partition 330 allows ions or electrons to move between the first space 22 and the second space 23 and suppresses the movement of water molecules. A first electrode 110 is then placed in the first space 22, and a second electrode 120 is placed in the second space 23.

Water 340 is then supplied and retained in the space 21 (S32). To be specific, water is supplied through the first inlet 24 and the second inlet 25 for a while so that first water 341 is retained in the first space 22 and second water 342 is retained in the second space 23.

It is also possible to use only one of the first inlet 24 and the second inlet 25 to supply water because water molecules can move through the partition 330. The reactor 20 therefore need not have both the first inlet 24 and the second inlet 25.

Then a plasma generator 100 generates plasma 142 in the water 340 (S33). In specific terms, plasma 142 is generated in the water 340 through the application of AC or pulse voltage between the first electrode 110 and the second electrode 120. This produces alkaline water 43 from the first water 341 and acidic water 44 from the second water 342.

To be more specific, a gas feeder 140 first supplies a gas into the second space 23 to make the second electrode 120 covered with the gas. A power supply 130 then applies pulse voltage to the first electrode 110 and the second electrode 120. A discharge initiated in a bubble 141 forming near the second electrode 120 generates plasma 142.

The first water 341, the partition 330, the second water 342, and the plasma 142 in the bubble 141 form a current path between the first electrode 110 and the second electrode 120. The resulting electrolysis of each of the first water 341 and the second water 342 produces alkaline water 43 from the first water 341 and acidic water 44 from the second water 342.

After, for example, the end of the generation of the plasma 142, i.e., the power supply 130 stops applying voltage, the produced alkaline water 43 and acidic water 44 are ejected through the first outlet 26 and the second outlet 27, respectively.

3. Experimental Results

Figure 13:
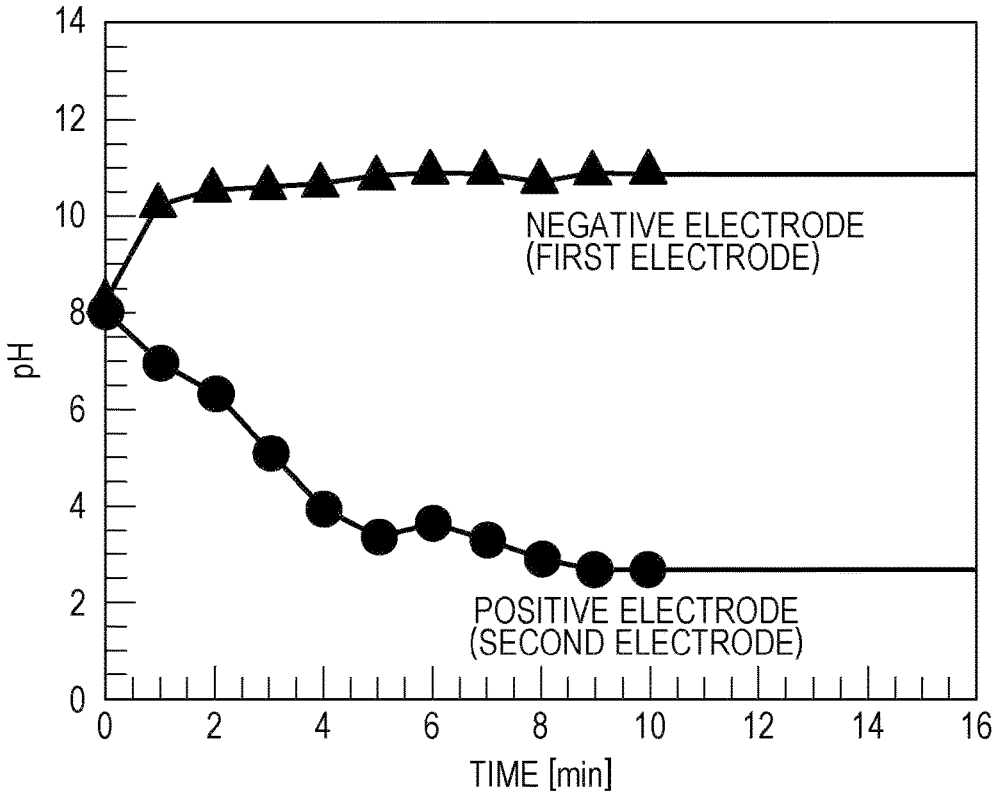
FIG. 13 illustrates pH values in a liquid treatment apparatus according to Embodiment 2 as measured near the first and second electrodes.

This section describes, with reference to FIG. 13, the results of a water treatment process performed using a liquid treatment apparatus 300 according to this embodiment. FIG. 13 illustrates the time-course of pH in water measured near each of the first electrode 110 and the second electrode 120 in the liquid treatment apparatus 300 according to this embodiment. The horizontal axis is the time from the start of voltage application. As in Embodiment 1, an H-shaped cell was used. However, water in the reactor 20 was kept substantially static, not allowed to flow.

Near the first electrode 110, as illustrated in FIG. 13, alkaline water 43 is produced with a pH of approximately 10. Near the second electrode 120, as illustrated in FIG. 13, acidic water 44 is produced with a pH of approximately 2.

As can be seen from the foregoing, the liquid treatment apparatus 300 according to this embodiment is able to produce alkaline water 43 and acidic water 44 simultaneously. In other words, keeping water in the space 21 static, i.e., controlling the water to make it not flow, allows simultaneous production of alkaline water 43 and acidic water 44. The produced alkaline water 43 and acidic water 44 can be used for, for example, dirt removal.

4. Dirt Removal

Figure 14:
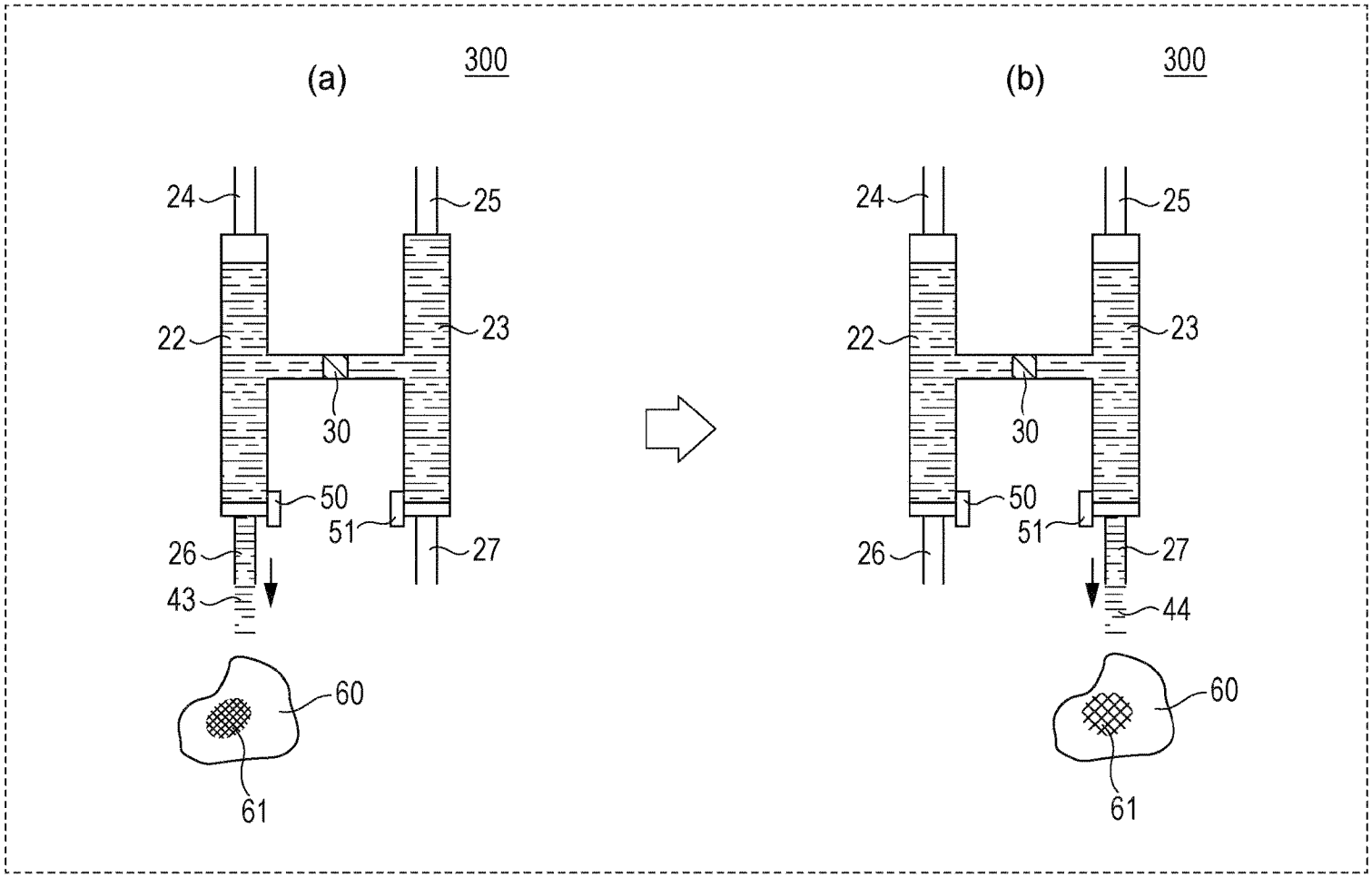
FIG. 14 schematically illustrates a removal of dirt with a liquid treatment apparatus according to Embodiment 2.

This section describes a method for removing dirt using a liquid treatment apparatus 300 according to this embodiment with reference to FIGS. 14 and 8. FIG. 14 schematically illustrates a removal of dirt with a liquid treatment apparatus 300 according to this embodiment.

The method according to this embodiment for removing dirt is substantially the same as that in Embodiment 1. That is, as illustrated in FIG. 8, a subject of treatment 60 including dirt 61 is brought into contact with alkaline water 43 first, and then with acidic water 44. In Embodiment 1, dirt is removed while plasma is generated, but in this embodiment, dirt is removed after the end of plasma generation.

To be specific, the valve 50 is first opened to release alkaline water 43 through the first outlet 26 as illustrated in FIG. 14 (*a*). The subject of treatment 60 is brought into contact with the released alkaline water 43.

Then the valve 51 is opened to release acidic water 44 through the second outlet 27 as illustrated in FIG. 14 (*b*). The subject of treatment 60 is brought into contact with the released acidic water 44.

The dirt 61 is detached from the subject of treatment 60 by alkaline water 43 and decomposed by the acidic water 44. As a result, the dirt 61 of the subject of treatment 60 is removed.

In this embodiment, it is impossible to circulate water. As illustrated in FIG. 14 (*a*), therefore, the quantity of alkaline water 43 in the first space 22 decreases as the alkaline water 43 is released. Likewise, as illustrated in FIG. 14 (*b*), the quantity of acidic water 44 in the second space 23 decreases as the acidic water 44 is released.

After the completion of the removal of the dirt 61, the space 21 can be replenished with water 340 through the supplying of tap water or similar into the space 21 through the first inlet 24 and the second inlet 25.

Thus, the liquid treatment apparatus 300 according to this embodiment is useful when alkaline water 43 and acidic water 44 are not continuously used. Requiring no pump or other equipment for circulating water, this apparatus can be of small size and low power consumption.

In this embodiment, the reactor is exemplified by a reactor 20. The liquid is exemplified by water 340. The plasma generator is exemplified by a plasma generator 100 including a first electrode 110, a second electrode 120, and a power supply 130. The inner wall that allows ions or electrons to move between the first and second spaces is exemplified by a partition 330.

Embodiment 3

In Embodiment 2, the partition that partitions the first space 22 and the second space 23 is a porous partition, but as illustrated in this embodiment, it is possible to use a water-pressure-based separating layer instead. The following describes the structure of a liquid treatment apparatus according to this embodiment with reference to FIG. 15.

1. Liquid Treatment Apparatus

Figure 15:
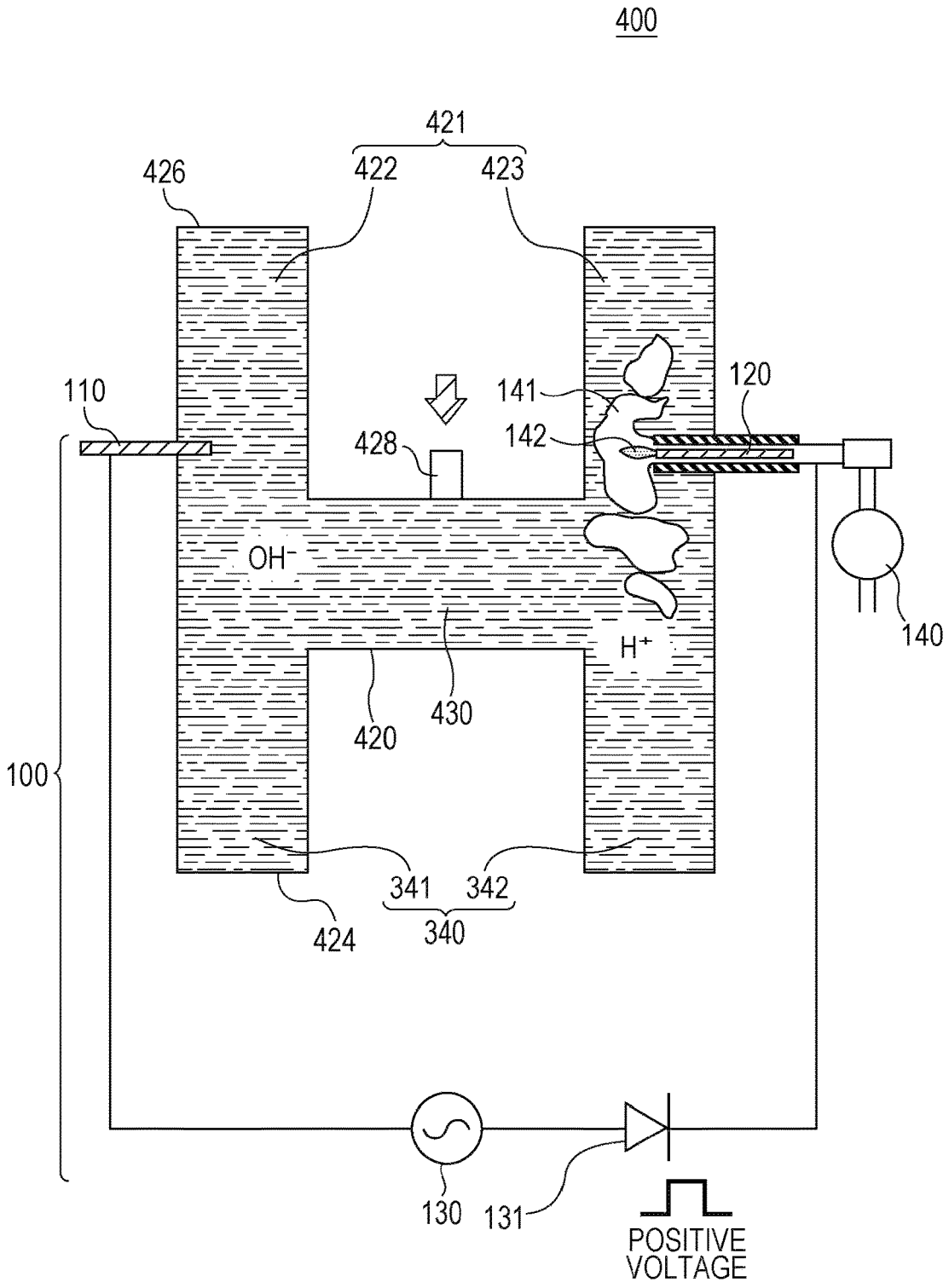
FIG. 15 illustrates the structure of a liquid treatment apparatus according to Embodiment 3.

FIG. 15 illustrates the structure of a liquid treatment apparatus 400 according to this embodiment.

As illustrated in FIG. 15, the liquid treatment apparatus 400 is different from the liquid treatment apparatus 300 according to Embodiment 2 in FIG. 11 in that it has a reactor 420 and a separating layer 430 instead of the reactor 20 and the partition 330. The following description focuses on differences.

1-1. Reactor

The reactor 420 is a vessel that forms a space 421 able to contain water. To be specific, the reactor 420 is an H-shaped cell.

The space 421 is separated by a separating layer 430 into a first space 422 and a second space 423. The first space 422 is located in one tube in the H-shaped cell, and the second space 423 is located in the other tube in the H-shaped cell.

The reactor 420 is composed of, for example, a pair of cylindrical tubes and a connecting tube that connects them. The reactor 420 is made of an acid- and alkali-resistant material. Examples of materials for the reactor 420 include plastic materials such as polyvinyl chloride, metallic materials such as stainless steel, and ceramic materials. The use of a ceramic material of glass reduces the consumption of acidic radicals.

The reactor 420 has an inlet 424 and an outlet 426. The inlet 424 is a part through which the space 421 is supplied with water, and the outlet 426 is a part through which the space 421 is drained.

The water supplied through the inlet 424 is retained in the first space 422 and the second space 423. The water therefore flows from the first space 422 into the second space 423 through the connecting tube of the H-shaped cell.

The reactor 420 also has a pressure control port 428. Connected with piping or similar, the pressure control port 428 forms a separating layer 430 in the vicinity thereof when, for example, a predetermined water pressure is externally applied.

1-2. Separating Layer

The separating layer 430 is a volume of water that exists in the boundary between the first space 422 and the second space 423 and in which the water pressure is kept higher than that in the first space 422 and the second space 423. In brief, the separating layer 430 is a wall of water formed by a high water pressure and suppresses the movement of water between the first space 422 and the second space 423. To be specific, the separating layer 430 is placed under a water pressure higher than that in the first space 422 and the second space 423 by the piping connected to the pressure control port 428.

2. Experimental Results

Figure 16:
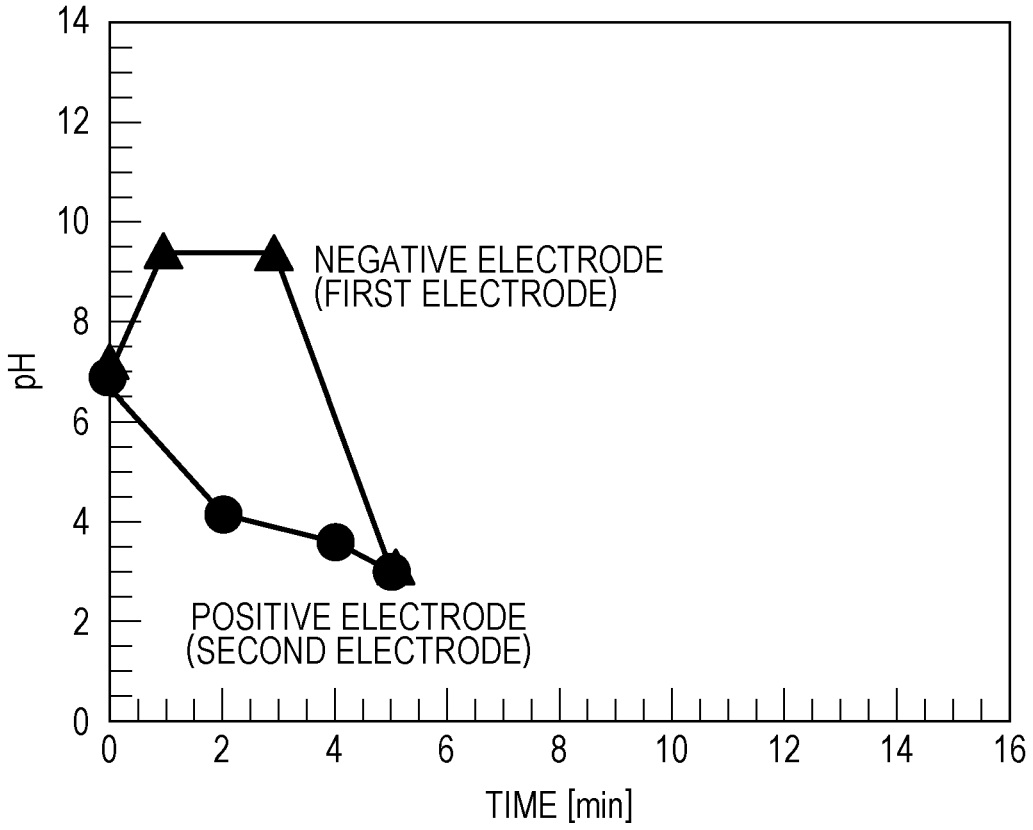
FIG. 16 illustrates pH values in a liquid treatment apparatus according to Embodiment 3 as measured near the first and second electrodes.

This section describes, with reference to FIG. 16, the results of a water treatment process performed using a liquid treatment apparatus 400 according to this embodiment. FIG. 16 illustrates the time-course of pH in water measured near each of the first electrode 110 and the second electrode 120 in the liquid treatment apparatus 400 according to this embodiment. As in Embodiment 2, an H-shaped cell was used.

As can be seen from FIG. 16, the pH of water increases near the first electrode 110 and decreases near the second electrode 120 with the start of voltage application. This demonstrates that alkaline water was produced in the first space 422, and acidic water was produced in the second space 423.

Five minutes after the start of voltage application, however, the pH near the first electrode 110 becomes substantially the same as that near the second electrode 120. This indicates that the alkaline water produced in the first space 422 and the acidic water produced in the second space 423 mixed with each other, making the entire water in the space 421 acidic.

This is attributable to a loss of the ability of the separating layer 430 to separate the first space 422 and the second space 423 with time. At the start of voltage application, the separating layer 430 is able to separate the first space 422 and the second space 423 because of the water pressure higher than that in the first space 422 and the second space 423. The electrolysis of water initiated by the application of voltage produces hydrogen in the first space 422 and oxygen in the second space 423.

As can be seen from formulae 1 and 2, the volume of the produced oxygen is half of that of the hydrogen. As a result, the water pressure on the second space 423 side is higher than that on the first space 422 side in the region where the first space 422 and the second space 423 are close to each other. When the difference in water pressure exceeds the water pressure in the separating layer 430, the acidic water in the second space 423 penetrates through the separating layer 430 into the first space 422, resulting in the mixing of acidic and alkaline waters.

Heat-induced convection should also be a cause of the mixing. Passing electric current for the generation of plasma elevates the temperature near the electrodes. This temperature elevation causes convection in the water. The inventor believes this is another cause of the mixing of acidic and alkaline waters.

In the mixture of acidic and alkaline waters, acidic radicals are abundant compared with alkaline radicals. The entire water in the space 421 therefore turns acidic.

Although the results in FIG. 16 indicate that alkaline and acidic waters mixed at approximately 5 minutes, the time of occurrence of the mixing depends on conditions, such as the quantity of water in the reactor 420, the water pressure in the separating layer 430, the length of the connecting tube of the H-shaped cell, and water temperature. For example, reducing the quantity of water in the reactor 420 extends the time for the mixing to occur. Elevating the water pressure in the separating layer 430 also delays the occurrence of the mixing. Increasing the length of the connecting tube also results in a delayed occurrence of the mixing. Furthermore, lowering the water temperature leads to a longer time for the mixing to occur.

3. Advantages and Other Information

In conclusion, the liquid treatment apparatus 400 according to this embodiment allows the user to produce a kind of alkaline water that turns into acidic water after a predetermined period of time. This alkaline water can therefore be used in applications such as dirt removal methods for removing insoluble dirt, like those in Embodiments 1 and 2.

The alkaline water according to this embodiment can also be used in applications such as hair coloring. For example, hair is colored through the contact of the hair with alkaline water and then with acidic water.

In specific terms, the hair is first brought into contact with an alkaline water containing a dye. This opens the cuticles, allowing the dye to penetrate into the hair. The hair is then brought into contact with acidic water, bleaching the melanin and oxidizing the dye to make its color come out.

The alkaline water produced by the liquid treatment apparatus 400 according to this embodiment, which turns into acidic water after a predetermined period of time, can be used for hair coloring. The adjustability of the time for the alkaline water to turn acidic, for example, allows easy management of time for the prevention of damage to hair.

In this embodiment, the reactor is exemplified by a reactor 420. The liquid is exemplified by water 340. The plasma generator is exemplified by a plasma generator 100 including a first electrode 110, a second electrode 120, and a power supply 130. The inner wall that allows ions or electrons to move between the first and second spaces is exemplified by a partition 430.

Other Embodiments

The foregoing is a description of some embodiments of apparatuses for treating a liquid, methods for treating a liquid, and methods for decomposing dirt according to one or more aspects of the present disclosure. The present disclosure, however, is not limited to these embodiments. Within the gist of the disclosure, the scope of the disclosure includes all variations of the embodiments conceivable to those skilled in the art, as well as all combinations of elements in different embodiments.

For example, the gas feeder 140 is connected to the second electrode 120 in the structures illustrated in the above embodiments, but this may be changed so that the gas feeder 140 is connected to the first electrode 110. That is, the electrode to which the gas feeder 140 is connected can be any of the positive electrode and the negative electrode as long as one of the pair of electrodes of the plasma generator 100 is supplied with a gas.

In a liquid treatment apparatus illustrated in FIG. 1, an inner wall of the connecting tube, instead of the partition 30, may serve as a conductor for ions or electrons to move between the first and second spaces. In other words, an inner wall of the connecting tube may be made of a material conductive to ions or electrons. This ensures ions or electrons are conducted between the water in the first space and the water in the second space through the inner wall of the connecting tube, allowing the production of acidic and alkaline waters as in Embodiment 1. The inner wall of the connecting tube can be made of, for example, the same material as the partition 30, an electroconductive plastic material, or graphite. In this embodiment, the inner wall of the reactor 20 is exemplified by an inner wall of the connecting tube.

It is also possible to use a structure in which the first space and the second space are formed by first and second vessels, respectively, connected in such a manner that ions or electrons are conducted therebetween. Such a structure prevents the mixing of water molecules, making the simultaneous production of alkaline and acidic waters more efficient.

A method according to an aspect of the present disclosure for removing dirt may include generating plasma in water to spatially separate the water into acidic and alkaline waters, bringing the alkaline water into contact with a subject of treatment including the dirt, and then bringing the acidic water into contact with the subject of treatment to decompose the dirt.

Various changes, such as modifications, substitutions, additions, and omissions, can be made to each of the above embodiments within the scope of the claims or the equivalent scope.

The present disclosure can be used in such a form as a liquid treatment apparatus able to simultaneously produce alkaline and acidic waters and can be used in applications such as dirt removal methods for removing dirt and methods for coloring hair.

What is claimed is:

1. A liquid treatment apparatus, comprising:

a reactor including a first space, a second space and a partition that separates the first space and the second space, each of the first space and the second space being capable of containing a liquid, the partition suppressing the liquid from moving between the first space and the second space and allowing ions or electrons to move between the first space and the second space; and a plasma generator configured to produce plasma in the liquid, the plasma generator including a first electrode, a second electrode, and a power supply that applies AC or pulse voltage between the first electrode and the second electrode, wherein:

a first portion of the first electrode is located in the first space, and a second portion of the second electrode is located in the second space, the reactor further includes:

a first inlet through which the liquid is supplied into the first space;

a second inlet through which the liquid is supplied into the second space;

a first outlet through which the liquid is drained from the first space; and a second outlet through which the liquid is drained from the second space, and when the reactor is arranged such that the second outlet is located vertically above the second inlet, a height of an uppermost portion of the partition measured from the second inlet in a vertical direction is smaller than a height of the second portion measured from the second inlet in the vertical direction.

2. The liquid treatment apparatus according to claim 1, wherein the partition includes an ion-exchange membrane or an electron conductive membrane.

3. The liquid treatment apparatus according to claim 1, wherein the partition includes a porous membrane.

4. The liquid treatment apparatus according to claim 1, wherein the plasma generator generates plasma while the liquid is flowing from the first inlet to the first outlet in the first space and from the second inlet to the second outlet in the second space.

5. The liquid treatment apparatus according to claim 1, wherein the plasma generator generates plasma while the liquid is retained in the first space and the second space.

6. The liquid treatment apparatus according to claim 1, wherein the plasma generator further comprises a gas feeder that supplies a gas into the liquid in the reactor such that the gas covers the first electrode or the second electrode.

7. The liquid treatment apparatus according to claim 6, further comprising:

an insulator, wherein:

a gap is provided between the insulator and the second electrode, and the second electrode has an opening through which the gas from the gas feeder is supplied into the liquid.

8. The liquid treatment apparatus according to claim 7, further comprising:

a holding block supporting the second electrode and the insulator with the gap.

9. The liquid treatment apparatus according to claim 8, wherein the insulator and the second electrode are configured to allow the gas from the opening to enter the gap and to cover the second electrode.

10. The liquid treatment apparatus according to claim 1, further comprising:

a first tube having the first space;

a second tube having the second space; and a third tube connecting the first tube and second tube, and including the partition.

11. The liquid treatment apparatus according to claim 10, wherein a combination of the first, second and third tubes has an H-shape.

12. The liquid treatment apparatus according to claim 1, wherein, when the reactor is arranged such that the second outlet is located vertically above the second inlet, the height of the uppermost portion of the partition is smaller than a height of the first portion measured from the first inlet in the vertical direction.

13. The liquid treatment apparatus according to claim 1, wherein the second portion does not directly face the partition in the second space.

14. The liquid treatment apparatus according to claim 12, wherein the first portion does not directly face the partition in the first space.

15. The liquid treatment apparatus according to claim 14, wherein the second portion does not directly face the partition in the second space.

16. The liquid treatment apparatus according to claim 10, wherein when the reactor is arranged such that the second outlet is located vertically above the second inlet, a height of an uppermost portion of an inner wall of the third tube measured from the second inlet in the vertical direction is smaller than the height of the second portion.

17. The liquid treatment apparatus according to claim 10, wherein when the reactor is arranged such that the first outlet is located vertically above the first inlet, a height of an uppermost portion of an inner wall of the third tube measured from the first inlet in the vertical direction is smaller than the height of the first portion.

* * * * *